US008991121B1

(12) United States Patent
Baker

(10) Patent No.: US 8,991,121 B1
(45) Date of Patent: Mar. 31, 2015

(54) THERMALLY IMPROVED CURTAIN WALL CONNECTION SYSTEM

(71) Applicant: Baker Metal Products, Inc., Dallas, TX (US)

(72) Inventor: Robert F Baker, Dallas, TX (US)

(73) Assignee: Baker Metal Products, Inc., Dallas, TX (US)

( * ) Notice: Subject to any disclaimer, the term of this patent is extended or adjusted under 35 U.S.C. 154(b) by 0 days.

(21) Appl. No.: 14/286,511

(22) Filed: May 23, 2014

Related U.S. Application Data

(60) Provisional application No. 61/826,876, filed on May 23, 2013, provisional application No. 61/872,707, filed on Aug. 31, 2013, provisional application No. 61/872,731, filed on Sep. 1, 2013.

(51) Int. Cl.
*E04B 2/88* (2006.01)
*E04B 2/96* (2006.01)

(52) U.S. Cl.
CPC ..... *E04B 2/965* (2013.01)
USPC ..... 52/235; 52/653.2; 52/655.1; 52/656.1; 52/656.9; 52/717.02

(58) Field of Classification Search
CPC ..... E04B 2/96; E04B 2/885; E04B 2/962; E04B 2/965; E04B 2/967
USPC ..... 52/235, 653.2, 655.1, 656.1, 656.5, 52/656.9, 464, 468, 717.02
See application file for complete search history.

(56) References Cited

U.S. PATENT DOCUMENTS

| | | | | | |
|---|---|---|---|---|---|
| 3,968,608 | A * | 7/1976 | Swango | 52/235 |
| 4,207,717 | A * | 6/1980 | Hubbard | 52/235 |
| 4,584,804 | A * | 4/1986 | Tajima | 52/235 |
| 4,614,067 | A * | 9/1986 | Matsubara | 52/235 |
| 4,672,784 | A * | 6/1987 | Pohlar | 52/235 |
| 5,105,593 | A * | 4/1992 | Kaminaga et al. | 52/235 |
| 6,658,804 | B2 * | 12/2003 | Leytes et al. | 52/235 |
| 6,748,709 | B1 * | 6/2004 | Sherman et al. | 52/235 |
| 7,134,247 | B2 * | 11/2006 | Ting | 52/235 |
| 8,011,146 | B2 * | 9/2011 | Krause | 52/235 |
| 8,800,221 | B1 * | 8/2014 | Header | 52/204.5 |
| 2005/0138875 | A1 * | 6/2005 | Grunewald et al. | 52/302.1 |
| 2011/0167743 | A1 * | 7/2011 | Ting | 52/235 |

FOREIGN PATENT DOCUMENTS

| | | | |
|---|---|---|---|
| CA | 2261208 | A1 * | 8/1999 |
| CA | 2406235 | A1 * | 11/2014 |
| DE | 10235823 | A1 * | 2/2004 |
| EP | 2390432 | A2 * | 11/2011 |
| FR | 2815062 | A1 * | 4/2002 |

* cited by examiner

*Primary Examiner* — Robert Canfield
*Assistant Examiner* — Matthew Gitlin
(74) *Attorney, Agent, or Firm* — Bill R. Naifeh

(57) ABSTRACT

Various disclosures of a horizontal stack joint system for a curtain wall is disclosed. In certain embodiments, the joint system comprises a lower subsystem having a dual member projection and an upper subsystem having a channel sized to receive the dual member projection.

20 Claims, 17 Drawing Sheets

THERMALLY IMPROVED CURTAIN WALL CONNECTION SYSTEM

CROSS REFERENCE TO RELATED APPLICATIONS

This application claims the benefit of the filing date of U.S. provisional patent application Ser. No. 61/826,876, filed on May 23, 2013, the disclosure of which is incorporated herein by reference for all purposes. This application also claims the benefit of the filing date of U.S. provisional patent application Ser. No. 61/872,707, filed on Aug. 31, 2013 and U.S. provisional patent application Ser. No. 61/872, 731 filed on Sep. 1, 2013. entitled "Thermally Improved Curtain Wall Connection System" of which all of the disclosures are hereby incorporated by reference for all purposes.

TECHNICAL FIELD

The invention relates in general to metal fabrication of curtain wall systems, and in particular to thermally improved curtain wall connection systems.

BACKGROUND INFORMATION

The use of structural steel and reinforced concrete in construction has allowed for large buildings to be supported by a system of columns rather than their exterior walls. Curtain walls are non-structural walls placed on the exterior of multistory buildings. The primary purpose of a curtain wall is to provide a barrier between building inhabitants and the outside elements. These curtain walls are traditionally aluminum frames filled with sheets of glass, metal, or stone. Glass is a popular choice because of the added benefit of allowing in natural light.

Curtain walls can be classified by their method of fabrication and installation into the following general categories: stick systems and unitized (also known as modular) systems. In the stick system, the curtain wall frame (mullions) and glass or opaque panels are installed and connected together piece by piece. In unitized systems, the curtain wall is composed of large units that are assembled and glazed in the factory, shipped to the site and erected on the building. Vertical and horizontal mullions of the modules mate together with the adjoining modules. Modules are generally constructed one story tall and one module wide but may incorporate multiple modules. Typical units are five to six feet wide.

Water penetration resistance is a function of glazing details, drainage details, sealants, and frame construction. Water can enter the exterior wall system by means of five different forces: gravity, kinetic energy, air pressure difference, surface tension, and capillary action. To mitigate water infiltration, all of these forces are usually accounted for in the curtain wall system design.

Unlike discontinuous windows, which are smaller units and can rely to a high degree on sill flashings to capture frame corner leakage, curtain walls cover large expanses of wall without sill flashings at each glazed opening. Water penetration of curtain wall frame corners is likely to leak to the interior and/or onto insulating glass below. Watertight frame corner construction and good glazing pocket drainage are critical for reliable water penetration resistance. Additionally, due to the reduction or lack insulation in curtain wall systems, the construction materials may conduct the heat or cold from the exterior of the building, and condensation can form as a result and may create internal weepage within the system.

Typically, curtain wall systems transfer their own dead load plus any live loads (which consist primarily of positive and negative wind loads) back to building structure or intermediate framing. In certain situations, the curtain wall system may demonstrate movement caused by thermal changes and wind significantly different than movement of the building structure. Therefore the connections to anchor the curtain wall must be designed to allow differential movement while resisting the loads applied while at the same time allow for weepage and the control of thermal transfers between the outside and inside of the building.

What is needed, therefore, is a device to act as an insulating frame and provide an effective gutter system for exterior condensation or rainwater while minimizing any weepage from reaching the interior and offering protection at the weak point of the seal.

SUMMARY

In response to these and other problems, in one embodiment, there are various disclosures of a horizontal stack joint system for a curtain wall disclosed. In certain embodiments, the joint system comprises a lower subsystem having a dual member projection and an upper subsystem having a channel sized to receive the dual member projection. In certain embodiments, the joint system includes male and female front legs, a gutter, male and female split mullions, a mullion splice, a female joint, sill trim members, mullion fins, horizontal fins, a gasket, a thermal isolator, silicone boot, a shop applied silicone seal and a field applied silicone seal.

These and other features, and advantages, will be more clearly understood from the following detailed description taken in conjunction with the accompanying drawings. It is important to note the drawings are not intended to represent the only aspect of the invention.

DETAILED DESCRIPTION

Figure 1:
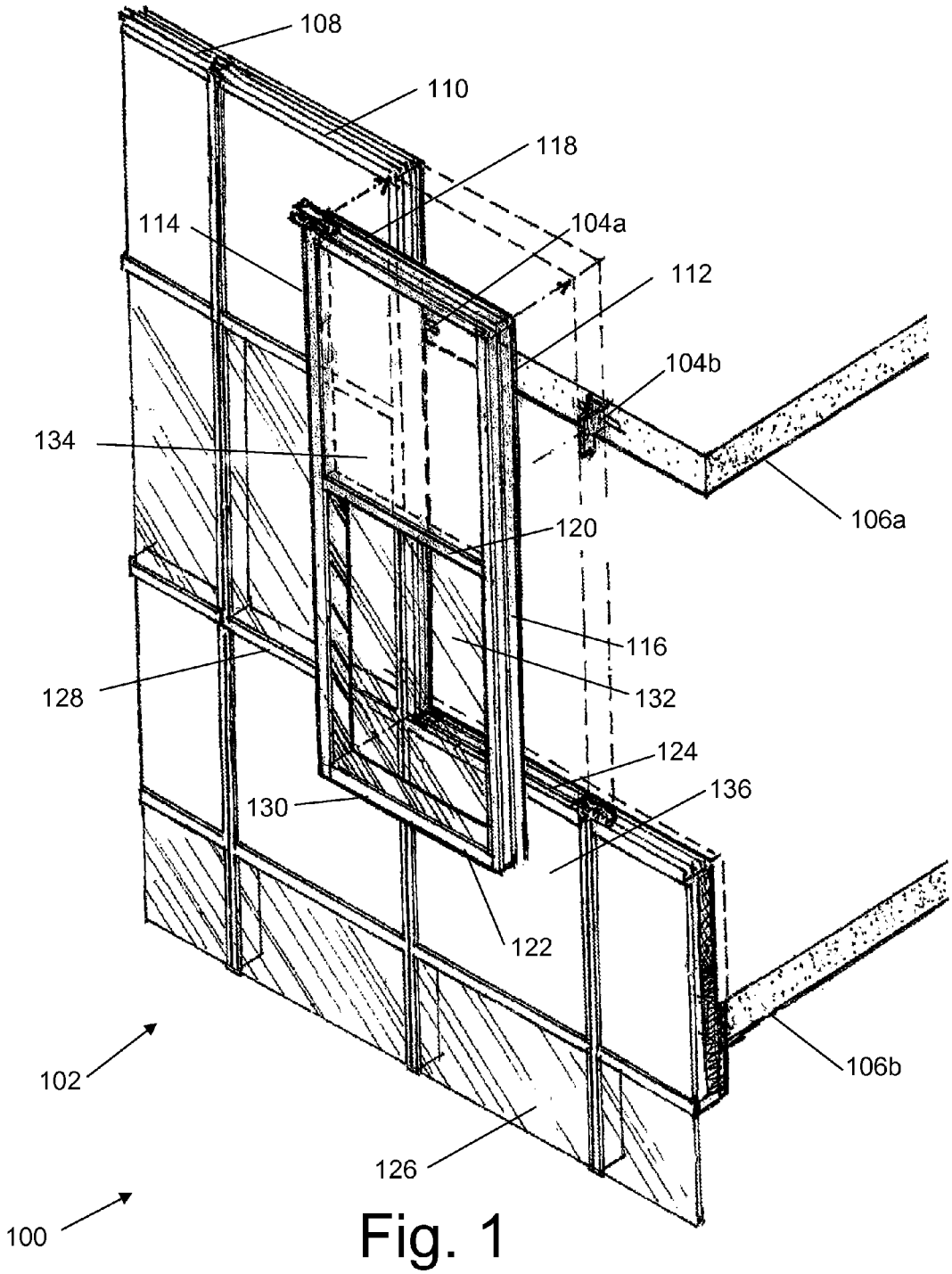
FIG. 1. is an isometric view of a portion of a typical curtain wall system comprising a plurality of stack joint systems.

For the purposes of promoting an understanding of the principles of the present inventions, reference will now be made to the embodiments, or examples, illustrated in the drawings and specific language will be used to describe the same. It will nevertheless be understood that no limitation of the scope of the invention is thereby intended. Any alterations and further modifications in the described embodiments, and any further applications of the principles of the inventions as described herein are contemplated as would normally occur to one skilled in the art to which the invention relates.

When directions, such as outer, inner, exterior, interior, upper, lower, top, bottom, clockwise, counter-clockwise, are discussed in this disclosure, such directions are meant to only supply reference directions for the illustrated figures and for orientated of components in the figures. The directions should not be read to imply actual directions used in any resulting invention or actual use. Under no circumstances, should such directions be read to limit or impart any meaning into the claims.

Curtain Wall System:

Prefabricated or unitized curtain wall systems are usually designed to accommodate the differential movement between the structure and the thermal movement of the frame at the joints between each curtain wall unit. Because these units are frequently custom designed, the amount of movement to be accommodated can be carefully engineered into the system. Anchoring of unitized curtain wall typically consists of a proprietary assembly with three-way dimensional adjustability. For instance, FIG. 1 illustrates a portion 102 of a unitized curtain wall system 100.

Typically, a plurality of anchors spaced at a predetermined distance, such as anchors 104*a* and 104*b*, attach the portion 102 of the curtain wall system 100 to a building structure such as a spandrel beam or floor slabs 106*a* and 106*b*. As illustrated in FIG. 1, there is typically a plurality of curtain wall units, such as unit 108 (only a portion of unit 108 is illustrated in FIG. 1) and unit 110 hung from the edge of the floor slab 106*a*. A unit 112 is about to be hung, and is thus shown positioned away from the floor slab 106*a*. Typically, differential movement between the curtain wall units is accommodated at the vertical and horizontal unit joints.

Each unit, such as unit 112, comprises framing members. In the illustrated situation, the unit 112 comprises a pair of vertical mullions 114 and 116 and two or more horizontal framing members, such as a top framing member 118, an intermediate framing member 120, and a bottom framing member 122. The vertical mullions 114 and 116 attach to the anchors 104*a* and 104*b*, respectively. When assembled, the bottom framing member 122 is positioned upon the top framing member 124 of the lower adjacent unit 126. Thus, when in place, the unit 112 spans horizontally from the anchor 104*a* to the anchor 104*b* which as explained above are positioned horizontally along the slab 106*a*. The unit 112 spans vertically from the top framing member 124 of the lower adjacent unit 126 to the anchors 104*a* and 104*b*, the unit 112 cantilevers above the slab 106*a* to a predetermined distance (for instance, desk height above the floor). Another unit (not shown) may then be placed adjacent to the vertical mullion 116 of the unit 112. Yet, another unit (not shown) may then be placed on the top framing member 118 of unit 112.

A horizontal stack joint 128 connects the units together to form the curtain wall system 100. The horizontal stack joints are designed to resist lateral loads while the two floor anchors resist gravity and lateral loads. Usually, at least one of the floor anchors 104*a* or 104*b* will allow movement in plane with the unitized system.

FIG. 1 illustrates the horizontal stack joint 128 completed where all adjacent units are in place and an open or incomplete stack joint 130 which will be formed once unit 112 is stacked on top of unit 126.

In the illustrated situation of FIG. 1, the units 108, 110, and 112 are composed of a lower panel 132 of "vision glass" and an upper panel 134 of an opaque glass or a glazed spandrel shadow box. In certain embodiments, the upper panel 134 may have an insulated back pan. Surrounding the lower panel 132 and the upper panel 134 are framing members as discussed above. Of course, the vision glass may be in the upper panel in other situations. Additionally, in yet other situations, the units may contain more than two panels.

Figure 2:
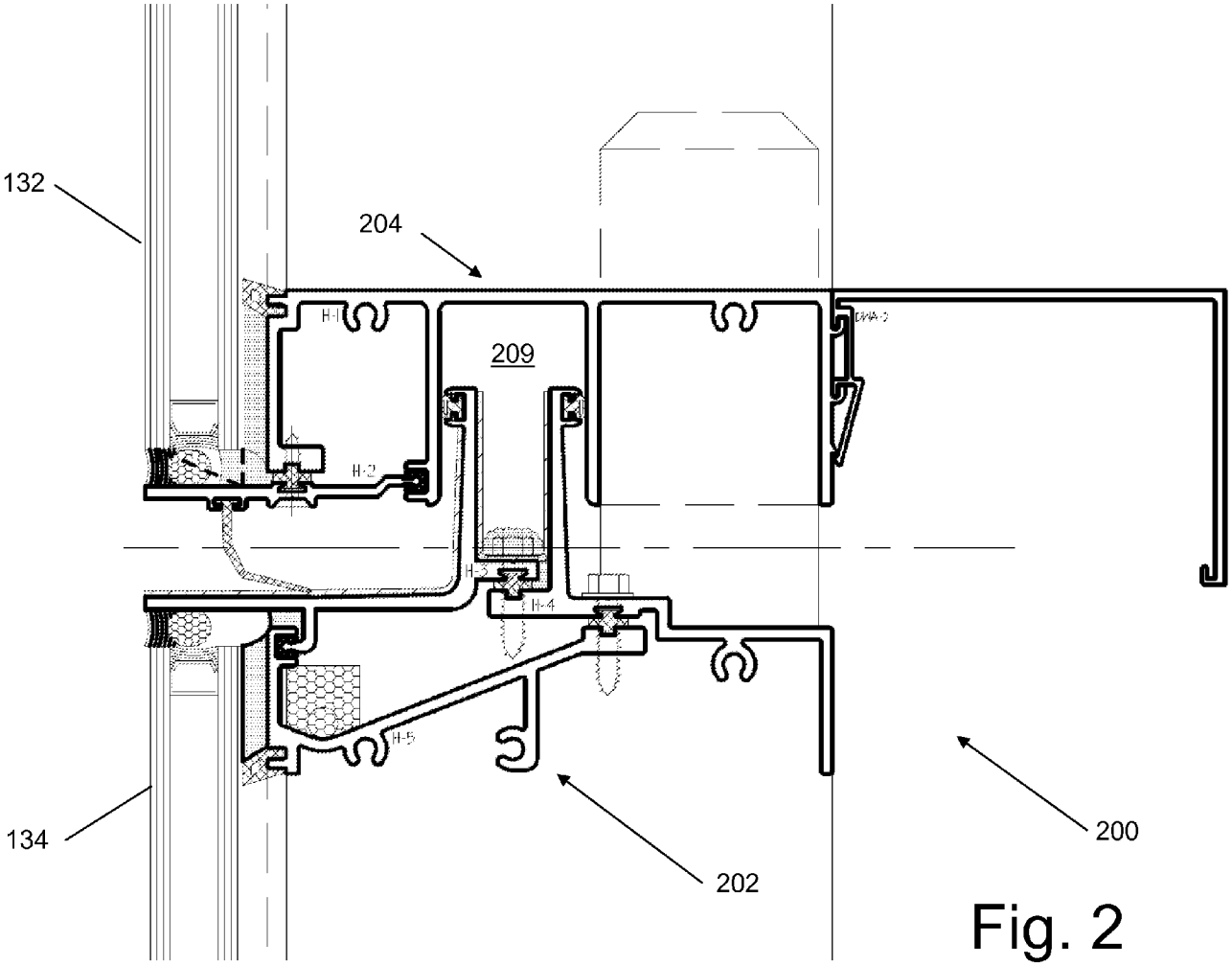
FIG. 2 is a section view illustrating one embodiment of a horizontal stack joint system which incorporates one or more aspects of the present invention.

Stack Joint System:

Turning now to FIG. 2, there is illustrated an exemplary stack joint system 200 generally comprising a lower subsystem 202 (which may be an upper framing member of a curtain wall unit, e.g. top framing member 118 of unit 112 or top framing member 124 or unit 126) and an upper subsystem 204 (which may be a lower or bottom framing member of a curtain wall unit, e.g. lower or bottom framing member 122 of unit 112).

FIG. 2 is a section view of a stack joint system 200 where the lower subsystem 202 is coupled to the upper subsystem 204 to form a completed stack joint system such as illustrated when in FIG. 1 unit 112 is positioned above unit 126. For instance, the lower panel 132 of vision glass may be coupled and supported by the upper subsystem 204 which is essentially the bottom framing member 122 of an upper unit, such as unit 112 (FIG. 1). In certain embodiments, the upper portion of opaque glass, such as panel 134 of the unit 112 or a panel 136 of the unit 126 (FIG. 1) may be coupled to and laterally supported by the lower subsystem 202 (which is essentially the top framing member of the respective curtain wall unit).

Figure 3A:
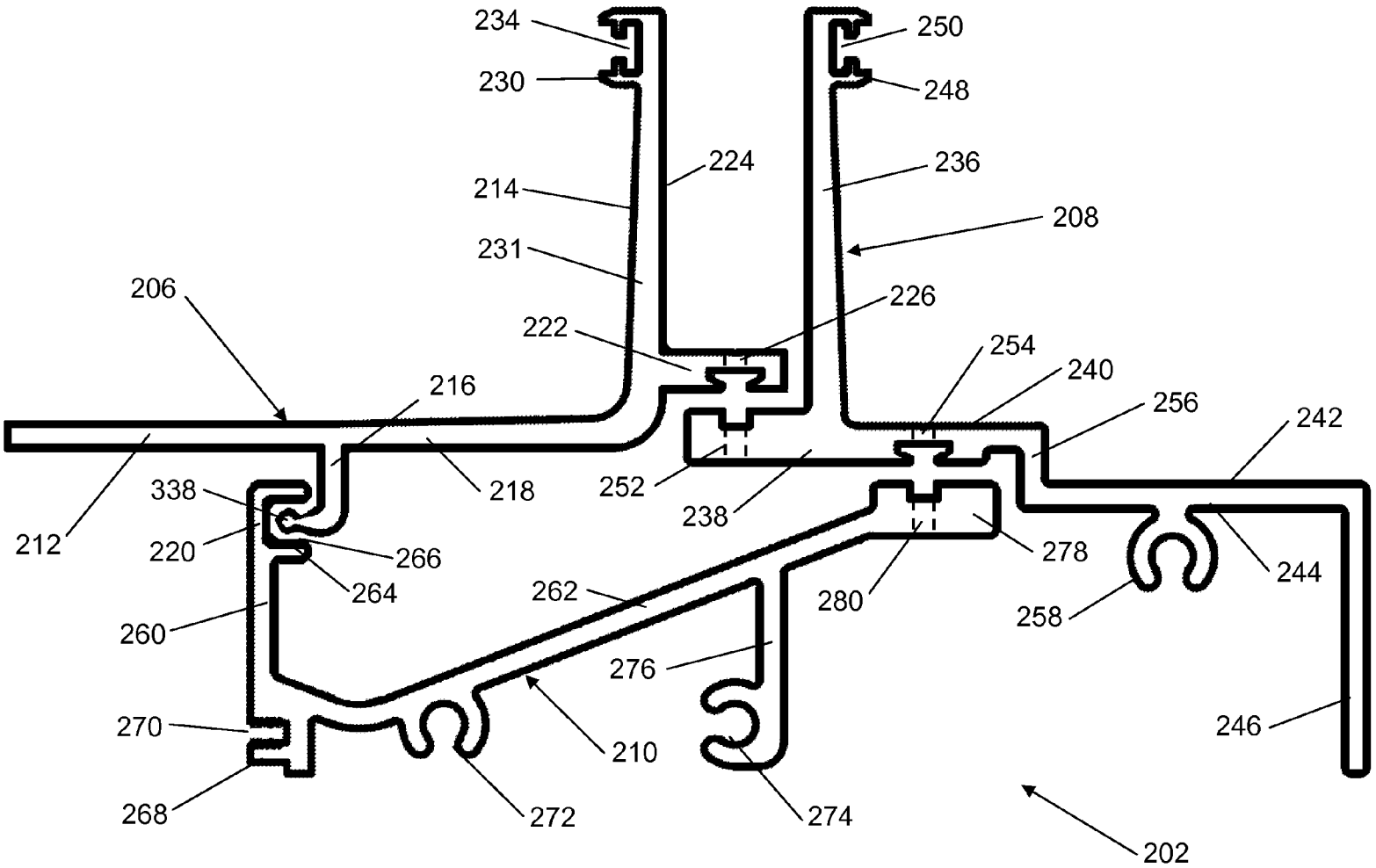
FIG. 3A is a section view illustrating the primary elements of one embodiment of a lower subsystem of the system of FIG. 2 which incorporates one or more aspects of the present invention.

As will be apparent when the details of the stack joint system 200 are discussed below, in certain embodiments, the stack joint system 200 creates an airtight or pressurized chamber 209. The pressurized chamber 209 may act as an air barrier of the curtain wall. To prevent rain infiltration through the curtain wall, it may be desirable to have an air tight or pressurized chamber, such as pressurized chamber 209. If the air that leaks in and through cracks and crevices of a curtain wall during a rain storm were limited or stopped, most of the water impinging on the curtain wall would migrate straight down the surface and little would penetrate the wall. Thus, if an airtight or pressurized element is positioned behind the exterior surface of a curtain wall, the chamber formed between the exterior cladding and the airtight element may reach the same air pressure level as is exerted on the cladding surface, thus removing the force which causes air to flow through any curtain wall opening. The "Rain Screen Wall," therefore is characterized by a chamber behind the exterior surface of the wall that is connected to the exterior but sealed tightly, or as tightly as reasonably possible to the interior.

the Lower Subsystem:

FIGS. 3A through 3D are various views of the lower subsystem 202 of the horizontal stack joint system 200. FIG. 3A is a section view illustrating the "structural" primary elements of one embodiment of the lower subsystem 202. The lower subsystem 202 comprises a male front leg 206, a male back leg 208, and a joint gutter 210. The male front leg 206 comprises an extruded metal member generally formed in the shape of an "L" with a horizontal leg 212 and a vertical leg 214. A curved protrusion 216 extends away from a lower surface or face 218 of the horizontal leg 212. As will be explained below, in certain embodiments, the curved protrusion 216 forms a male portion of a connection 220 between the horizontal leg 212 and the joint gutter 210.

A generally horizontal protrusion 222 extends from a back or interior face 224 of the vertical leg 214. In certain embodiments, the horizontal protrusion 222 may have one or more screw holes 226 for an assembly screw 228 (see FIG. 3B). In certain embodiments, a groove protrusion 230 extends from the top portion of a front face 231 of the vertical leg 214. The groove protrusion 230 is sized to allow a gasket 318 (see FIG. 3B) to fit within a groove 234 formed by the groove protrusion 230.

The male back leg 208 comprises a vertical leg 236, a front protrusion 238, an intermediate section 240, and a back portion 242. In certain embodiments, the back portion 242 comprises a horizontal portion 244 which connects to a vertical portion 246.

In certain embodiments, the vertical leg 236 may also include a groove protrusion 248 containing a groove 250. In certain embodiments, the groove protrusion 248 is essentially a mirrored protrusion of the groove protrusion 230. Thus, the groove protrusion 230 faces towards the exterior of the system and the groove protrusion 248 faces towards the interior of the system and/or building. The front protrusion 238 also has a screw hole 252 such that when the primarily components are assembled into a stack joint, the screw hole 252 aligns with the screw hole 226 of the male front leg 206, such that the assembly screw 228 can couple the male front leg 206 to the male back leg 208.

In certain embodiments, the intermediate section 240 may also have a screw hole 254. In certain embodiments, the intermediate section 240 may have a downward vertical portion 256 which joins the intermediate section to the back or interior portion 242. In certain embodiments, the various legs 206, 208, or joint gutter 210 may have screw splines for connecting screws (not shown) to out of plane members (not shown), such as screw spline 258.

In certain embodiments, the joint gutter 210 may be extruded into a shape which generally comprises a vertical leg 260 joined to an inclined leg or member 262. In certain embodiments, at a top end of the vertical leg 260, there may be a groove portion 264 forming a longitudinal groove 266. At the bottom of the vertical leg 260, there may be a groove portion 268, containing a longitudinal groove 270 designed to couple with a gasket (not shown). As discussed above, various screw splines, such as screw spline 272 and screw spline 274 may be formed along the inclined member 262 to couple out-of-plane members (not shown). In certain embodiments, extension members, such as extension member 276, may be formed to position the screw spline 274 in the correct horizontal and vertical position. The inclined leg 262 may end with a connecting portion 278. A screw hole 280 may be defined within the connecting portion 278. When the subsystem 202 is assembled, the screw hole 280 may be aligned with the screw hole 254 of the back leg 208 such that a assembly screw 282 (FIG. 3B) can couple the back leg 208 to the joint gutter 210.

Figure 3B:
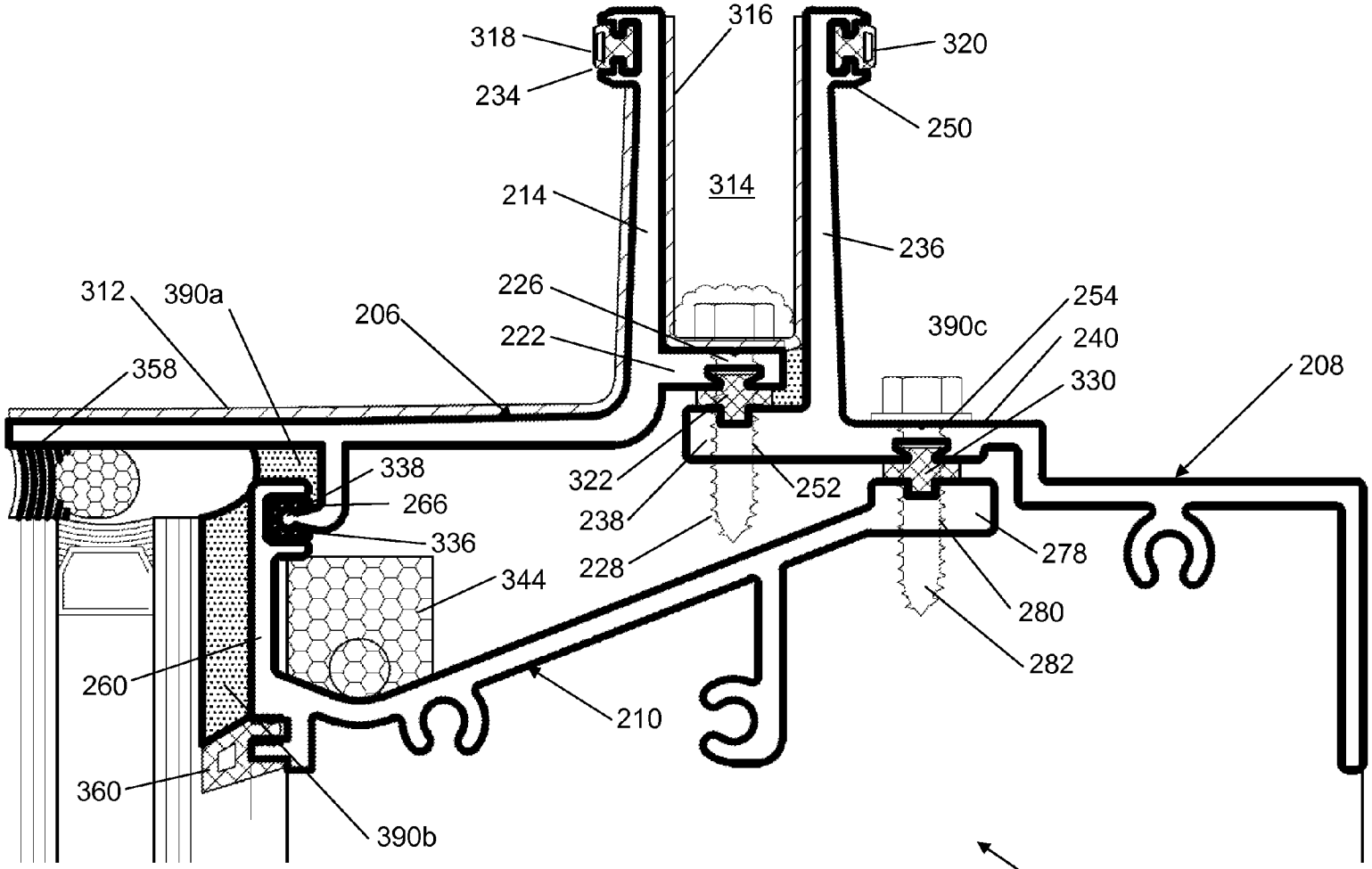
FIG. 3B is a more detailed section view illustrating one embodiment of a lower subsystem of the system of FIG. 2 which incorporates one or more aspects of the present invention.
Figure 3C:
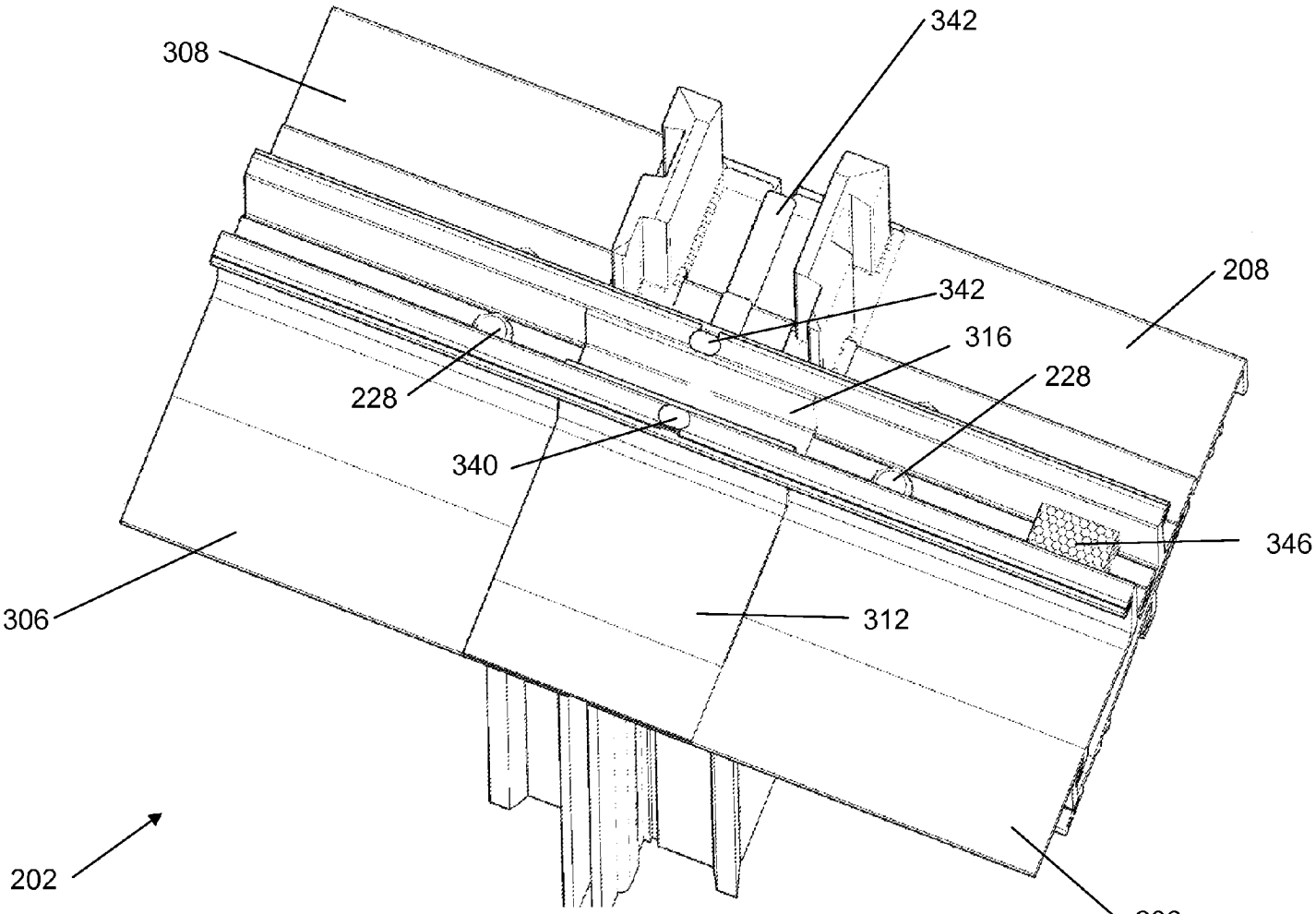
FIG. 3C is a top isometric view illustrating two adjacent lower subsystems coupled together.
Figure 3D:
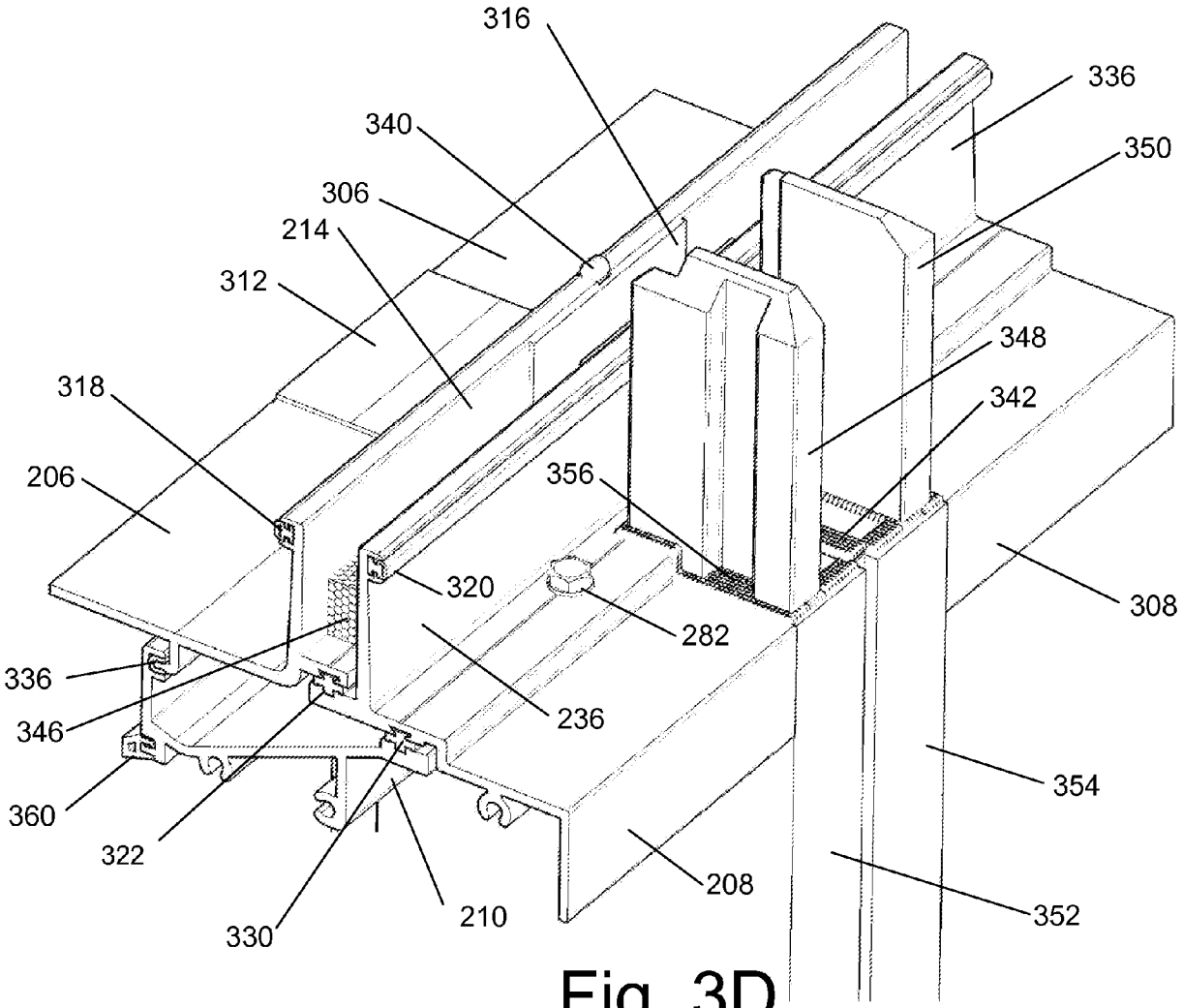
FIG. 3D is a traditional isometric view illustrating two adjacent lower subsystems coupled together.

Now that exemplary features and geometry of the front leg 206, the back leg 208, and the joint gutter 210 have been described, attention will be directed to FIGS. 3B, 3C, and 3D. FIG. 3B is a section view of the stack joint lower subsystem 202 cut at a where the subsystem 202 from one of units meets a similar subsystem from an adjacent unit at a stack joint. FIG. 3C is a top isometric view of a lower subsystem 202 for the entire stack joint which is formed by two adjacent subsystems 202. Similarly, FIG. 3D is a side isometric view of the lower subsystem 202 for the entire stack joint.

Turning now to FIGS. 3B, 3C, and 3D, as discussed above, the lower subsystem 202 comprises the male front leg 206, the male back leg 208, and the joint gutter 210. As illustrated in FIGS. 3C and 3D, when the units are assembled, the male front leg 206 is positioned adjacent to a female front leg 306 of an adjacent subsystem of an adjacent unit. Similarly, the male back leg 208 couples with a female back leg 308 of an adjacent subsystem of the adjacent unit.

As illustrated in FIGS. 3B, 3C and 3D in certain embodiments, the top surfaces of the male front leg 206 and the female front leg 306 may be coupled to a silicone boot 312 at the joint. Once the male front leg 206 and male back leg 208 are assembled, the vertical leg 214 and the vertical leg 236 form a channel 314. At the joint, the interior of the channel 314 may be lined with a second silicone boot 316. The silicone boot 312 prevents water from running down the joint created by the male front leg 206 and the female front leg 306. Similarly, the silicone boot 316 prevents water from running down the joint created by the male back leg 208 and the female back leg 308.

A weather seal, such as a gasket 318 may be inserted into the groove 234 defined within the vertical leg 214. Similarly, a second weather seal, such as a gasket 320 may be inserted into the groove 250 defined within the vertical leg 236 of the male back leg 208. In certain embodiments, another thermal isolator, such as a rigid PVC spacer strip 322 may be inserted horizontally into grooves defined within the bottom face of the horizontal protrusion 222 of the male front leg 206 and defined within the top face of the front protrusion 238 of the male back leg 208. In certain embodiments, the PVC spacer strip 322 may have openings (not shown in FIG. 3B) sized to allow one or more assembly screw 228 to pass through the openings. In certain embodiments, the PVC spacer strip 322 is positioned such that the openings of the PVC spacer strip align with the screw holes 226 and 252. Thus, the assembly screw 228 may extend into the screw hole 226 of the horizontal protrusion 222 through the PVC spacer strip 322 and through the screw hole 252 of the front protrusion 238 of the back leg 208. In other words, the front leg 206 and the back leg 208 may be connected, but remain relatively thermally isolated.

In certain embodiments, another thermal isolator, such as a rigid PVC spacer strip 330 may be inserted horizontally into grooves defined within the bottom face of the intermediate section 240 of the male back leg 208 and defined within the top face of the connecting portion 278 of the joint gutter 210. In certain embodiments, the PVC spacer strip 330 has one or more openings sized to allow one or more assembly screws 282 to pass through the opening. In certain embodiments, the PVC spacer strip 330 is positioned such that the PVC spacer strip openings align with the screw holes 254 and 280. Thus, the assembly screw 282 may extend into the screw hole 254 of the intermediate section 240 through the PVC spacer 330 and through the screw hole 280 of the connecting portion 278 of the joint gutter 210. In other words, the back leg 208 and the joint gutter 210 may be connected, but remain relatively thermally isolated.

A third thermal isolator, such as a rigid PVC tubular member 336 may be inserted into the groove 266 defined within the vertical leg 260 of the joint gutter 210 to form a third thermal isolating connection. A circular end portion 338 of the curved protrusion 216 may be inserted into the tubular member 336 as illustrated in FIG. 3D. Thus, the front leg 206 and the joint gutter 210 may be connected, but remain relatively thermally isolated.

Thus, the lower joint subsystem 202 includes the male front leg 206 (having a first vertical leg 214) which is coupled to the male back leg 208 (having a second upper or vertical leg 236) via a thermal isolation joint (e.g., the assembly screw 228 and the PVC spacer 322). The subsystem 202 also includes a joint gutter 210 which couples to the front leg 206 via a second thermal isolation joint (e.g., the curved protrusion 216 and the PVC tubular member 336 which allows some rotation) and couples to the back leg 208 via a third isolation joint (e.g., the assembly screw 282 and the PVC spacer 330).

As illustrated in FIGS. 3C and 3D, the male front leg 206 is positioned longitudinally adjacent to the female front leg 306. A field applied silicone seal 340 may be applied between the male front leg 206 and the female front leg 306. Similarly, the male back leg 208 is positioned longitudinally adjacent to the female back leg 308. A field applied silicone seal 342 may be applied between the male back leg 206 and the female back leg 306.

In certain embodiments, there may be one or more weep holes defined with a lower surface of the joint gutter, a baffle 344 may be positioned at the weep hole in order to minimize air from infiltrating the joint (See FIG. 3B). In certain embodiments, a baffle, such as baffle 346 may be positioned within the channel 314 (see FIG. 3C or 3D).

In certain embodiments, there may also be vertical mullion splice members 348 and 350 which may also function as lifting lugs. The vertical mullion splice member 348 may be coupled to a vertical split mullion male member 352 (see FIG. 3D). Similarly, the vertical mullion splice member 350 may be coupled to a vertical split mullion female member 354 (see FIG. 3D). In certain embodiments, a shop applied silicone seal 356 may be applied between the male back leg 208 and the vertical splice member 348. Similarly, a shop applied silicone seal (not shown) may be applied between the female back leg 308 and the vertical mullion splice member 350 to prevent water from seeping through the joint. In various locations, other gaskets and seals may be used to prevent water infiltration such as glazing seal 358 or gasket 360 as is known in the art. Additionally, field applied caulking or sealing may also be employed, such as 390*a*, 390*b*, and 390*c*.

Figure 4A:
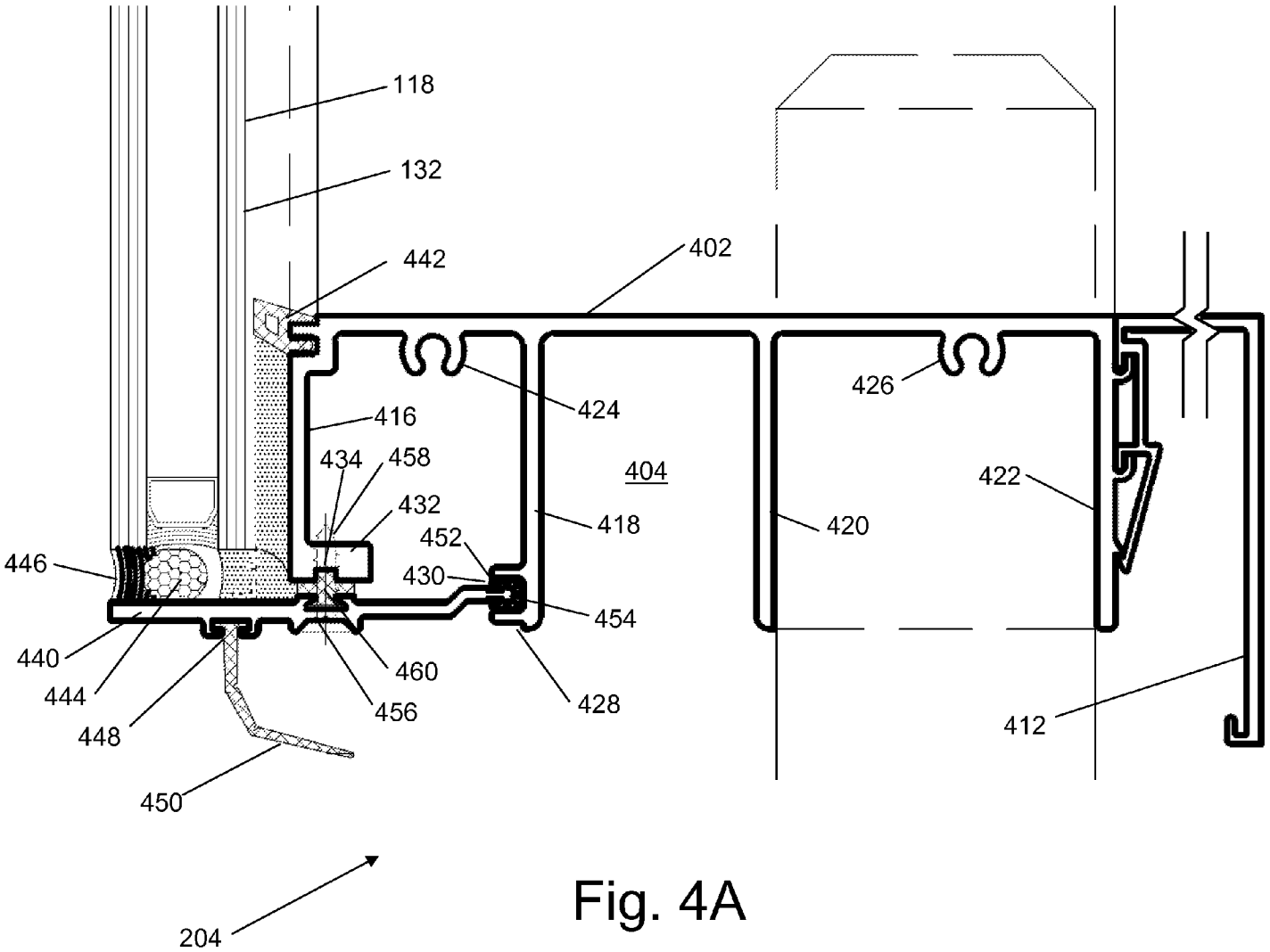
FIG. 4A is a section view illustrating one embodiment of an upper subsystem of the system of FIG. 2.

Turning back to FIG. 3D, three thermal isolation members (e.g., PVC spacer 322, PVC spacer 330, and PVC tubular member 336) isolate the interior male back leg 208 from the exterior elements: front leg 206 and joint gutter 210. Additionally, the vertical leg 214 of the front leg 206 and the vertical leg 236 of the back leg 208 along with the gaskets 318 and 320 proved a dual line of defense for the stack joint. The subsystem 202 also provides for internal weepage through weep holes and baffles, such as baffle 344 (not shown). Additionally, the vertical mullion splice members 348 and 350 are positioned behind the vertical legs 236.

the Upper Subsystem:

FIG. 4A is a section view through certain horizontal members of the upper subsection 204 of FIG. 2 (or lower framing member of a curtain wall unit). As illustrated, in certain embodiments, a stack joint female member 402 may have a plurality of downward pointing vertical members or legs, such as vertical leg 416, vertical leg 418, vertical leg 420 and vertical leg 422. Vertical leg 418 and vertical 420 form the channel 404 and are spaced such that they can accept the vertical legs 214 and 236 of the lower subsystem 202 (See FIG. 2 and FIG. 3B) to create an air tight or pressurized chamber (chamber 209 of FIG. 2). In certain embodiments, the stack joint female member 402 may also have screw splines 424 and 426 for coupling with out of plane screws (not shown).

In certain embodiments, a groove portion 428 forming a longitudinal groove 430 may be defined at the lower end of the vertical leg 418. The vertical leg 416 may have a connecting portion 432. In certain embodiments, one or more screw hole(s) 434 is defined within the connecting portion 432.

A horizontal fin 440 may be used to support a lower panel of glass, such as lower panel 132 of vision glass which may be part of an upper unit, such as top framing member 118 (FIG. 1). In certain embodiments, a gasket 442 may be coupled to the upper stack joint female member 402 and positioned such that the gasket 442 is between the upper stack joint member 402 and the lower panel 132 of vision glass. A backer rod 444 and seal 446 may be positioned between the lower panel 132 and the horizontal fin 440 as illustrated in FIG. 4A. In certain embodiments, there may be a longitudinal groove 448 for accepting and coupling with a gasket 450 that is positioned between the horizontal fin 440 and the male front leg 206 of the lower subsystem 202.

In section, an interior end 452 of the horizontal fin 440 is circular and is designed to fit within a thermal isolator, such as a rigid partially tubular PVC member 454. In turn, the rigid PVC tubular member 454 may be sized to be inserted into the groove 430 defined within the vertical leg 418 of upper stack joint member 402 to form a thermal isolating connection. Thus, the vertical leg 418 and the horizontal fin 440 may be connected, but remain relatively thermally isolated.

In certain embodiments, the horizontal fin 440 may have one or more screw holes 456 such that when the horizontal fin is coupled to the stack joint member 402, the screw hole 456 and screw hole 434 align so that an assembly screw 458 may be placed in the screw holes to couple the connecting portion 432 of the vertical leg 416 to the horizontal fin 440. The assembly screw 458 may go through a thermal isolating member, such as a PVC spacer strip 460 which may be positioned between the horizontal fin 440 and the connecting portion 432 of the vertical leg 416.

In certain embodiments, the PVC spacer strip 460 may be inserted horizontally into grooves defined within the bottom face of the connecting portion 432 of the vertical leg 416 and defined within the top face of the horizontal fin 440. In certain embodiments, the PVC spacer strip 460 may have openings (not shown in FIG. 4B) sized to allow one or more assembly screw(s) 458 to pass through the openings. In certain embodiments, the PVC spacer strip 460 is positioned such that the openings of the PVC spacer strip align with the screw holes 434 and 456. Thus, the stack joint member 402 may be coupled and supports the horizontal fin 440, but is thermally isolated from the horizontal fin via the PVC spacer strip 460 and the rigid tubular PVC tubular member 454.

Figure 4B:
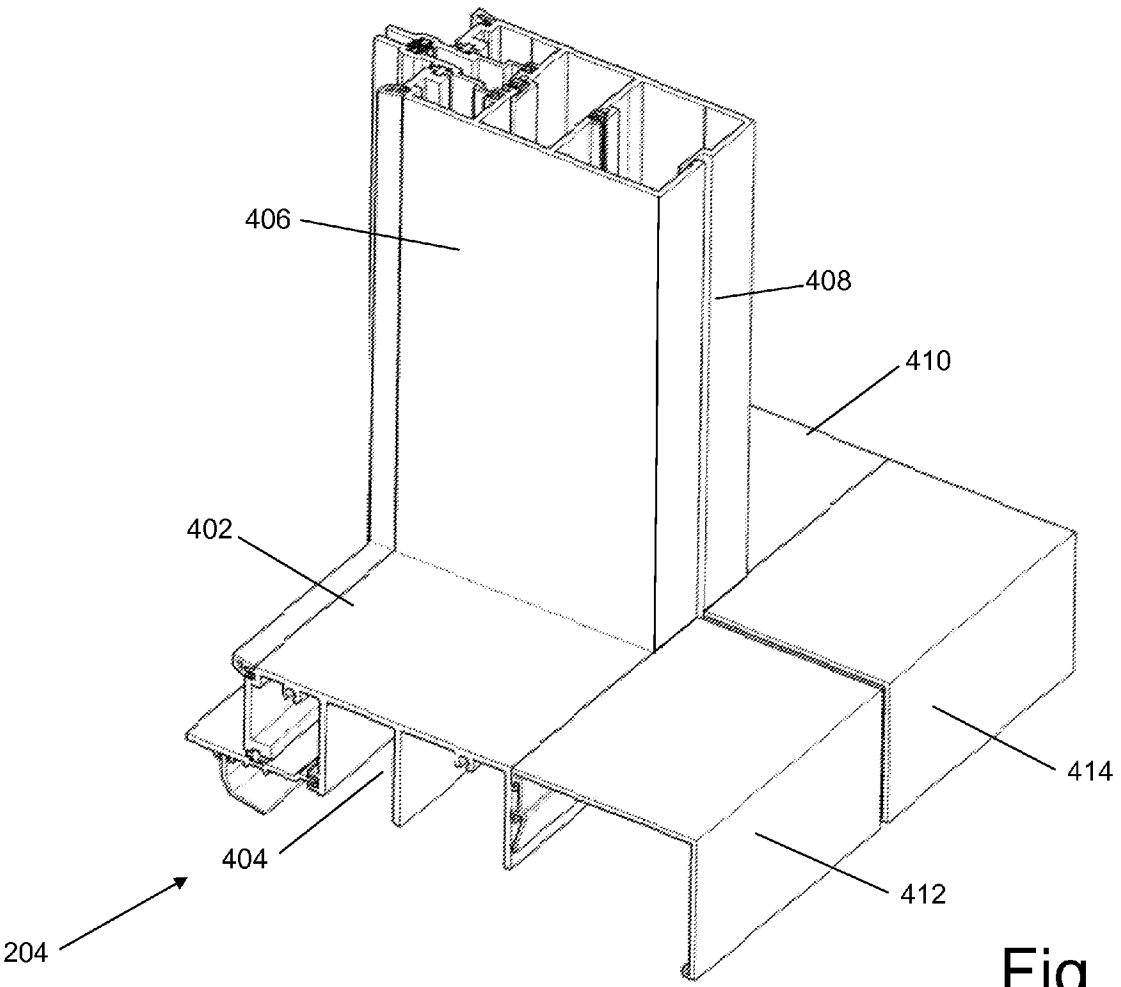
FIG. 4B is a traditional isometric view illustrating one embodiment of two adjacent upper subsystems coupled with a vertical mullion subsystem.

The female or upper stack joint female member 402 may be made of extruded aluminum. In certain embodiments, the stack joint female member 402 may be coupled to a split male mullion 406 as illustrated in FIG. 4B. A split female mullion 408 may be coupled to a stack joint female member 410 of an adjacent unit. If required, the stack joint female members 402 and 410 may be coupled to snap on sill trim members 412 and 414, respectively.

Figure 5A:
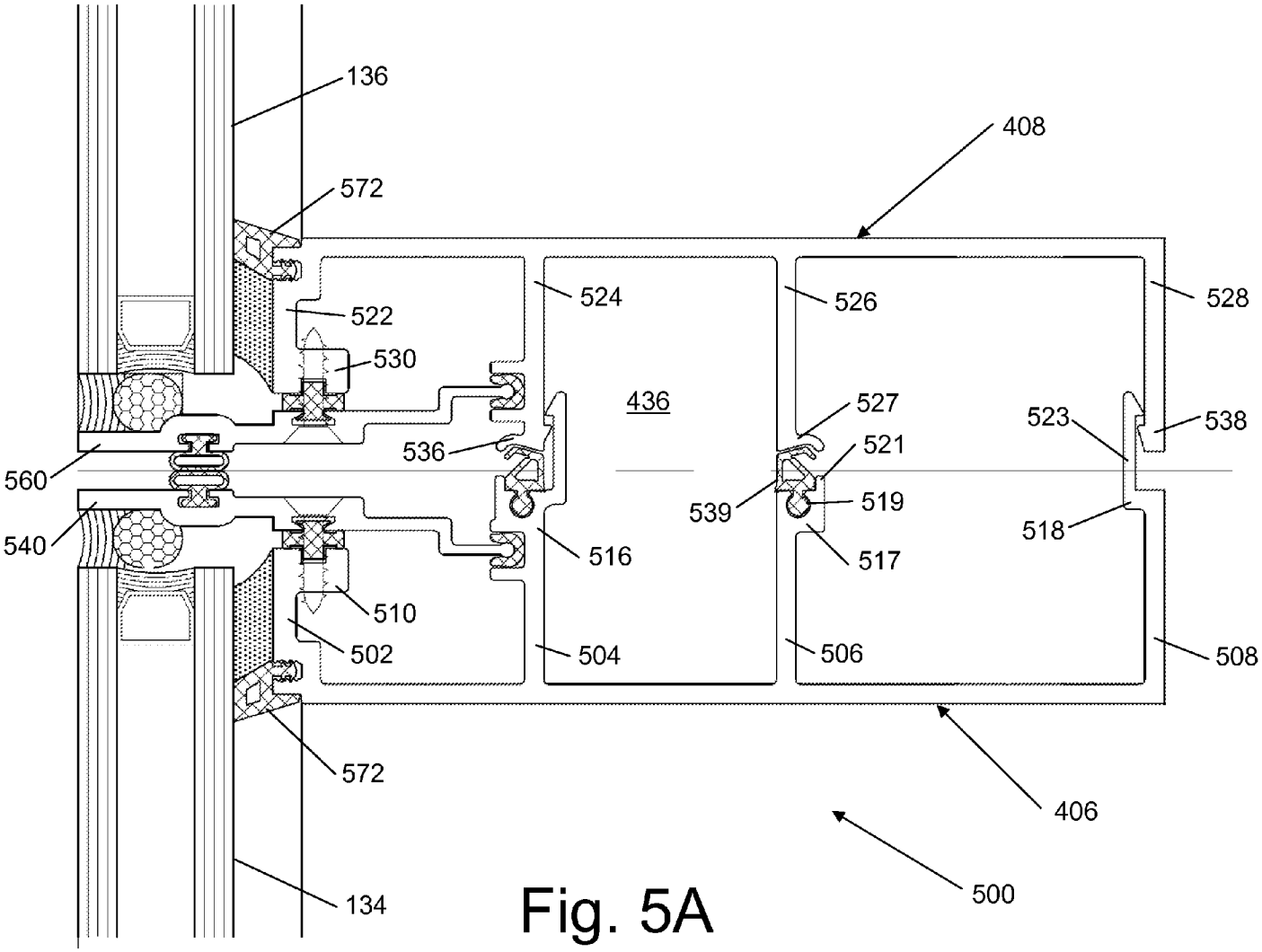
FIG. 5A is a section view of a vertical mullion subsystem which may be used with various embodiments of the present invention.
Figure 5B:
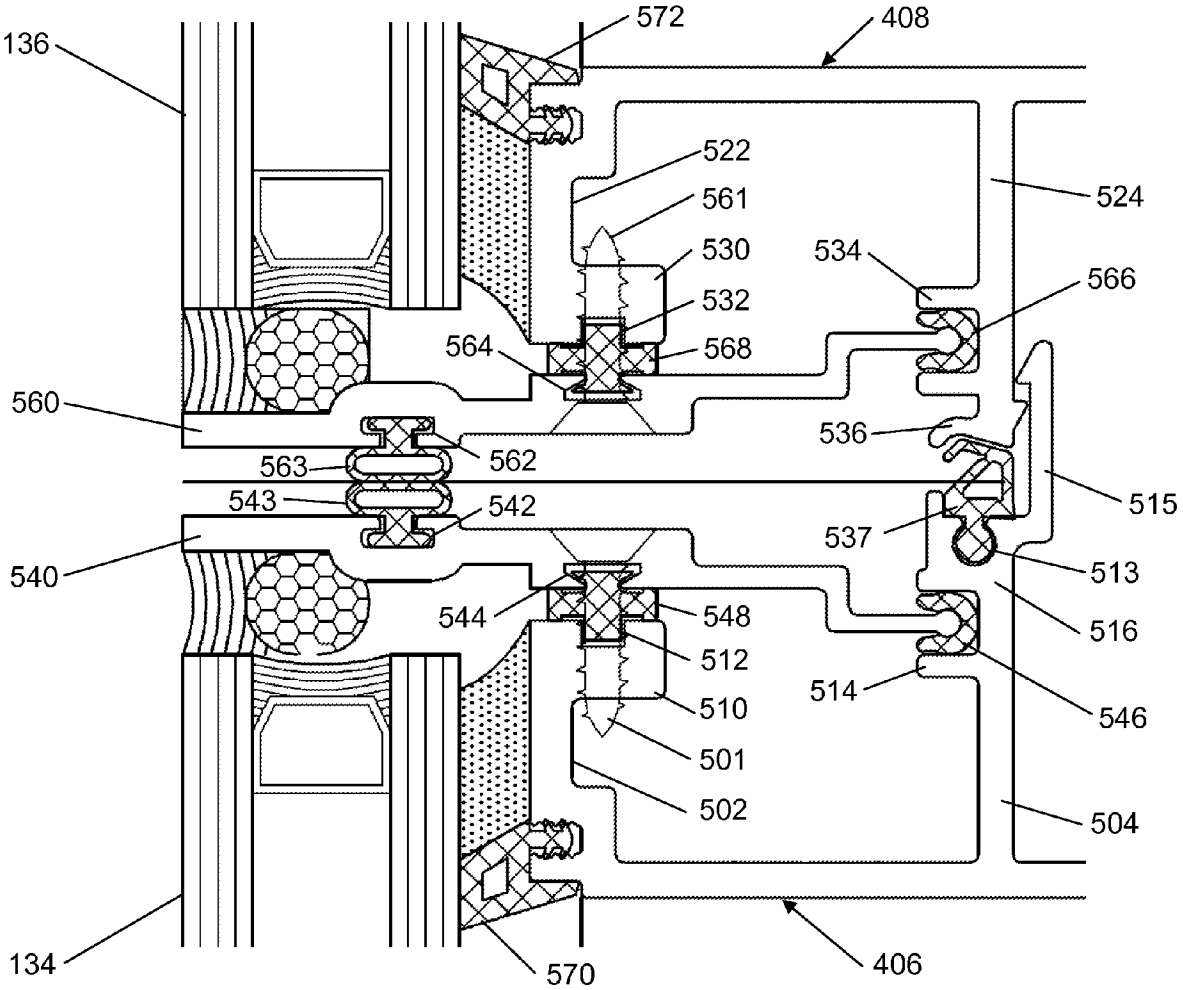
FIG. 5B is a detailed section view of a portion of the vertical mullion subsystem of FIG. 7A.

The Vertical Mullion System:

FIG. 5A is a detailed section view showing a mullion joint system 500 formed from certain vertical members or mullions. For instance, in FIG. 4B, mullions 406 and 408 are coupled to the upper subsystems 204, respectively of adjacent units. FIG. 5B is an enlarged detailed portion of the section view illustrated in FIG. 5A.

Turning now to FIGS. 5A and 5B, there is illustrated in section the interconnection between the split male mullion 406 and the split female mullion 408. As illustrated, the split male mullion 406 may include a lateral member 502, a lateral member 504, a lateral member 506, and a lateral member 508.

In certain embodiments, the lateral member 502 may have a connecting end portion 510 with a vertical groove 512. The lateral member 504 may have a side groove portion 514 and a connecting end portion 516 with a circular groove 513 defined on one face and a snap or hook element 515 extending laterally outward. A portion of a flexible member or gasket 537 may be inserted vertically into the circular groove 513 such that the gasket 537 is coupled to the end portion 516 of the lateral member 504.

The lateral member 506 has a connecting end portion 517 with a circular groove 519 defined on one face and a small engagement extension 521 extending laterally outward. A portion of a flexible member or gasket 539 may be inserted vertically into the circular groove 519 such that the gasket 539 is coupled to the end portion 517 of the lateral member 506. The lateral member 508 has a connecting end portion 518 with a snap or hook element 523 extending laterally outward.

Similarly, the split female mullion 408 may include a lateral member 522, a lateral member 524, a lateral member 526, and a lateral member 528. The lateral member 522 may have a connecting end portion 530 with a vertical groove 532. The lateral member 524 may have a side groove portion 534 and a connecting end portion 536. In some embodiments, in section the end portion 536 is shaped to engage a portion of the snap or hook portion 515 of the lateral member 504. The end portion 536 is also shaped to engage the gasket 537 which is coupled to the end portion 516 of the lateral member 504 so that the connection between the end portion 536 and the end portion 516 is hermetically sealed.

In certain embodiments, the lateral member 526 may have a connecting end portion 527 which may be shaped to engage the gasket 539 (which is coupled to the connecting end portion 516 of the member 506) so that the connection between the end portion 527 of the lateral member 526 and the end portion 517 of the lateral member 506 is hermetically sealed. Thus, a vertical pressurized or airtight chamber 436 is formed because the connection between lateral members 504 and 524 and the connection between lateral members 506 and 526 are sealed. The airtight chamber 436 is open to and in hermetic communication with airtight chamber 209 (discussed in reference to FIG. 2). A rectangular airtight chamber, therefore, is created for the unit as the units are positioned to create the curtain wall system.

In certain embodiments, a mullion fin 540 and a mullion fin 560 may be positioned within the space between the connecting portions 510 and 530 of the lateral members 502 and 522, respectively. Generally, the mullion fins 540 and 560 extend from the vertical grooves 514 and 534, to approximately the exterior face of the glass panels (e.g., the glass panels 134 and 136 of FIG. 1). The mullion fins 540 and 560 may comprise a series of "step sections" in cross-section to allow their interior ends to clear the connection between the lateral members 504 and 524.

The mullion fin 540 may have a vertical groove 542 for securing a gasket 543. The opposing face of the mullion fin 540 may have vertical groove 544 defined therein. The interior end of the mullion fin 540 may also be circular in shape to couple with a thermal isolator, such as a rigid PVC vertical tubular member 546 which may be inserted into the side groove portion 514 of the lateral member 504. Similarly, the mullion fin 560 may have a vertical groove 562 for securing a gasket 563. Thus, as illustrated, gasket 543 and gasket 563 are aligned and are pressed against each other.

The opposing face of the mullion fin 560 may have a vertical groove 564 defined therein. The interior end of the mullion fin 560 may also be circular in shape to couple with a thermal isolator, such as a rigid PVC vertical tubular member 566 which may be inserted into the groove portion 534 of the lateral member 524.

A thermal isolator, such as a rigid PVC vertical member 548 may be formed to be coupled with a vertical groove 544 defined within the mullion fin 540 and the vertical groove 512 defined within the connecting end portion 510 of the lateral member 502. In certain embodiments, one or more assembly screws 501 may secure the mullion fin 540 to the connecting end portion 510 of the lateral member 502. Thus, although the lateral member 502 is mechanically coupled to the mullion fin 540, the lateral member 502 is thermally isolated from the mullion fin via the PVC vertical member 548.

Similarly, a thermal isolator, such as a rigid PVC vertical member 568 may be formed to be couple with the groove 564 defined within the mullion fin 560 and a groove 532 defined within the connecting end portion 530 of the lateral member 522. In certain embodiments, one or more assembly screws 561 may secure the mullion fin 560 to the connecting end portion 530 of the lateral member 522. Thus, although the lateral member 522 is mechanically coupled to the mullion fin 560, the lateral member 522 is thermally isolated from the mullion fin via the PVC vertical member 568.

The exterior corner of the split male mullion 406 may be formed to engage and couple with a gasket 570. Similarly, the exterior corner of the split female mullion 408 may be formed to engage and couple with a gasket 572. As illustrated, the gaskets 570 and 572 are positioned between the respective mullions and the glass panels (e.g., the glass panels 134 and 136 of FIG. 1).

Turning back to FIG. 1, it is apparent that most of the units (e.g. unit 112) in the curtain wall system 100 comprise a top or upper horizontal system which is similar to the lower subsystem 202 of FIG. 2; a bottom or lower horizontal system which is similar to the upper subsystem 204 of FIG. 2, a side mullion system which contains the mullion 406, and a side mullion system which contains the mullion 408. As the units are positioned or "stacked" adjacent to and above one another, joint systems are formed between the units. For instance, stack joint systems 200 (FIG. 2) are formed horizontally between the respective units and mullion joint systems 500 (FIGS. 5A and 5B) are formed vertically between the respective units.

Figure 6:
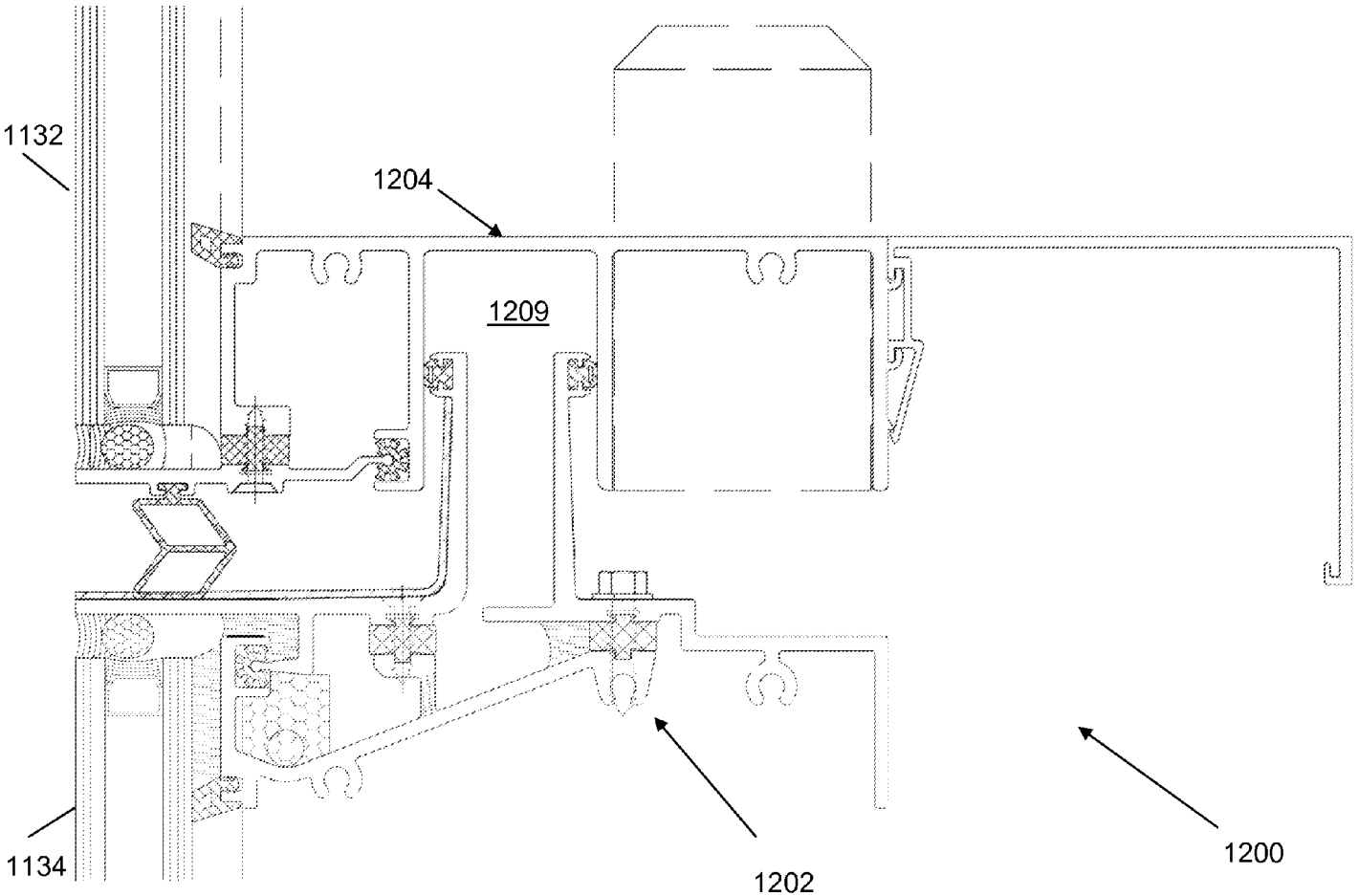
FIG. 6 is a section view illustrating an embodiment of a horizontal stack joint system which incorporates one or more aspects of the present invention.

Stack Joint System (Alternative Embodiment):

Turning now to FIG. 6, there is illustrated an exemplary stack joint system 1200 generally comprising a lower subsystem 1202 (which may be an upper framing member of a curtain wall unit, e.g. top framing member 118 of unit 112 or top framing member 124 or unit 126 (FIG. 1)) and an upper subsystem 1204 (which may be a lower or bottom framing member of a curtain wall unit, e.g. lower or bottom framing member 122 of unit 112 (FIG. 1)).

FIG. 6 is a section view of a stack joint system 1200 where the lower subsystem 1202 is coupled to the upper subsystem 1204 to form a completed stack joint system such as illustrated when in FIG. 1 unit 112 is positioned above unit 126. For instance, the lower panel 1132 of vision glass may be coupled and supported by the upper subsystem 1204 which is essentially the bottom framing member 122 of an upper unit, such as unit 112 (FIG. 1). In certain embodiments, the upper portion of opaque glass, such as panel 1134 of the unit 112 or a panel 136 of the unit 126 (FIG. 1) may be coupled to and laterally supported by the lower subsystem 1202 (which is essentially the top framing member of the respective curtain wall unit).

As will be apparent when the details of the stack joint system 1200 are discussed below, in certain embodiments, the stack joint system 1200 creates an airtight or pressurized chamber 1209. The pressurized chamber 1209 may act as an air barrier of the curtain wall. To prevent rain infiltration through the curtain wall, it may be desirable to have an air tight or pressurized chamber, such as pressurized chamber 1209. If the air that leaks in and through cracks and crevices of a curtain wall during a rain storm were limited or stopped, most of the water impinging on the curtain wall would migrate straight down the surface and little would penetrate the wall. Thus, if an airtight or pressurized element is positioned behind the exterior surface of a curtain wall, the chamber formed between the exterior cladding and the airtight element may reach the same air pressure level as is exerted on the cladding surface, thus removing the force which causes air to flow through any curtain wall opening. The "Rain Screen Wall," therefore is characterized by a chamber behind the exterior surface of the wall that is connected to the exterior but sealed tightly, or as tightly as reasonably possible to the interior.

Figure 7A:
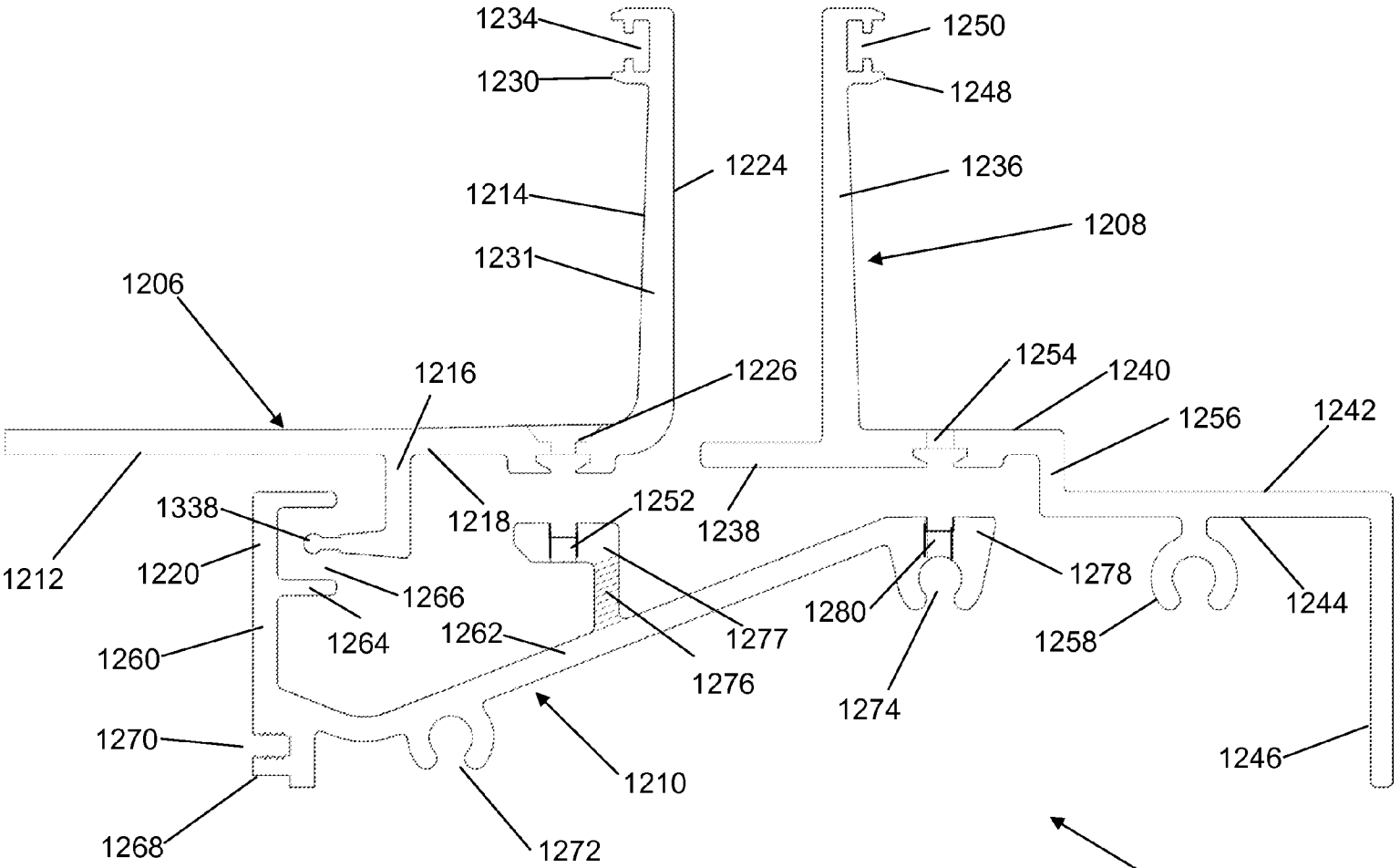
FIG. 7A is a section view illustrating the primary elements of one embodiment of a lower subsystem of the system of FIG. 6.

The Lower Subsystem (Second Embodiment):

FIGS. 7A through 7D are various figures illustrating various aspects of the lower subsystem 1202. FIG. 7A is a section view illustrating the primary "structural" elements of one embodiment of the lower subsystem 1202. The lower subsystem 1202 comprises a male front leg 1206, a male back leg 1208, and a joint gutter 1210. The male front leg 1206 comprises an extruded metal member generally formed in the shape of an "L" with a horizontal leg 1212 and a vertical leg 1214. A curved protrusion 1216 extends away from a lower surface or face 1218 of the horizontal leg 1212. As will be explained below, in certain embodiments, the curved protrusion 1216 forms a male portion of a connection 1220 between the horizontal leg 1212 and the joint gutter 1210.

In certain embodiments, the horizontal leg 1212 may have one or more screw holes 1226 for an assembly screw 1228 (not shown). In certain embodiments, a groove protrusion 1230 extends from the top portion of a front face 1231 of the vertical leg 1214. The groove protrusion 1230 is sized to allow a gasket 1318 (see FIG. 7B) to fit within a groove 1234 formed by the groove protrusion 1230.

The male back leg 1208 comprises a vertical leg 1236, a front protrusion 1238, an intermediate section 1240, and a back portion 1242. In certain embodiments, the back portion 1242 comprises a horizontal portion 1244 which connects to a vertical portion 1246.

In certain embodiments, the vertical leg 1236 may also include a groove protrusion 1248 containing a groove 1250. In certain embodiments, the groove protrusion 1248 is essentially a mirrored protrusion of the groove protrusion 1230. Thus, the groove protrusion 1230 faces towards the exterior of the system and the groove protrusion 1248 faces towards the interior of the system and/or building.

In certain embodiments, the intermediate section 1240 may also have a screw hole 1254. In certain embodiments, the intermediate section 1240 may have a downward vertical portion 1256 which joins the intermediate section to the back or interior portion 1242. In certain embodiments, the various legs 1206, 1208, or joint gutter 1210 may have screw splines for connecting screws (not shown) to out of plane members (not shown), such as screw spline 1258.

In certain embodiments, the joint gutter 1210 may be extruded into a shape which generally comprises a vertical leg 1260 joined to an inclined leg or member 1262. In certain embodiments, at a top end of the vertical leg 1260, there may be a groove portion 1264 forming a longitudinal groove 1266. At the bottom of the vertical leg 1260, there may be a groove portion 1268, defining a longitudinal groove 1270 designed to couple with a gasket (not shown). In certain embodiments, an extension member 1276 may project upwards and contain a horizontal connecting portion 1277. One or more screw holes 1252 may be defined within the horizontal connecting portion 1277. As noted above, the horizontal leg 1212 may have one or more screw holes 1226 which may align with the screw holes 1252 when the primary components are assembled into a lower subsystem 1202 of the stack joint 1200.

In certain embodiments, the inclined leg 1262 may end with a connecting portion 1278 and may be formed to position the screw spline 1274. A screw hole 1280 may be defined within the connecting portion 1278. When the subsystem 1202 is assembled, the screw hole 1280 may be aligned with the screw hole 1254 of the back leg 1208 such that an assembly screw 1282 (FIG. 7B) can couple the back leg 1208 to the joint gutter 1210.

As discussed above, various screw splines, such as screw spline 1272 and screw spline 1274 may be formed along the inclined member 1262 to couple out-of-plane members (not shown).

Figure 7B:
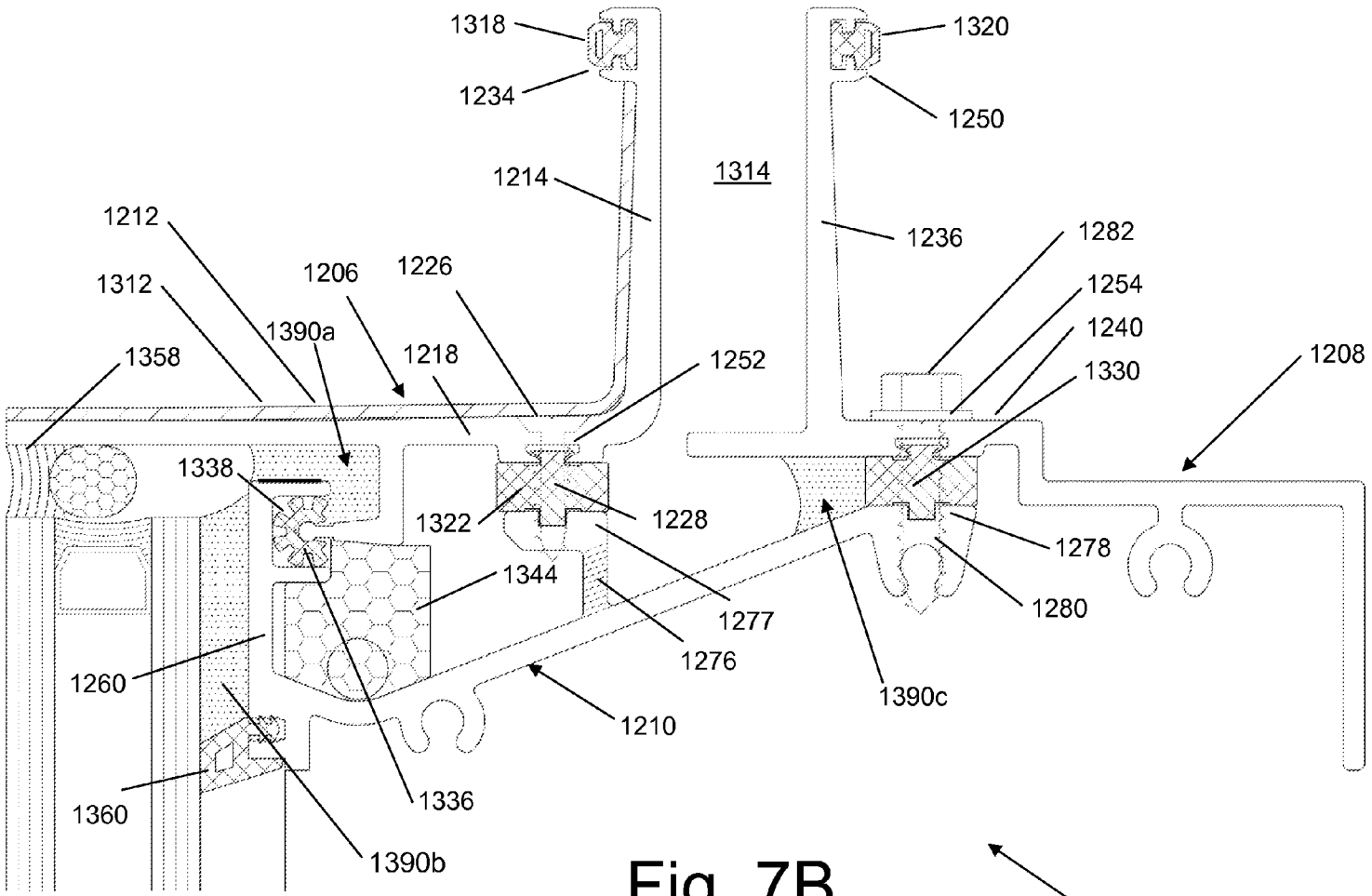
FIG. 7B is a more detailed section view illustrating one embodiment of a lower subsystem of the system of FIG. 6.
Figure 7C:
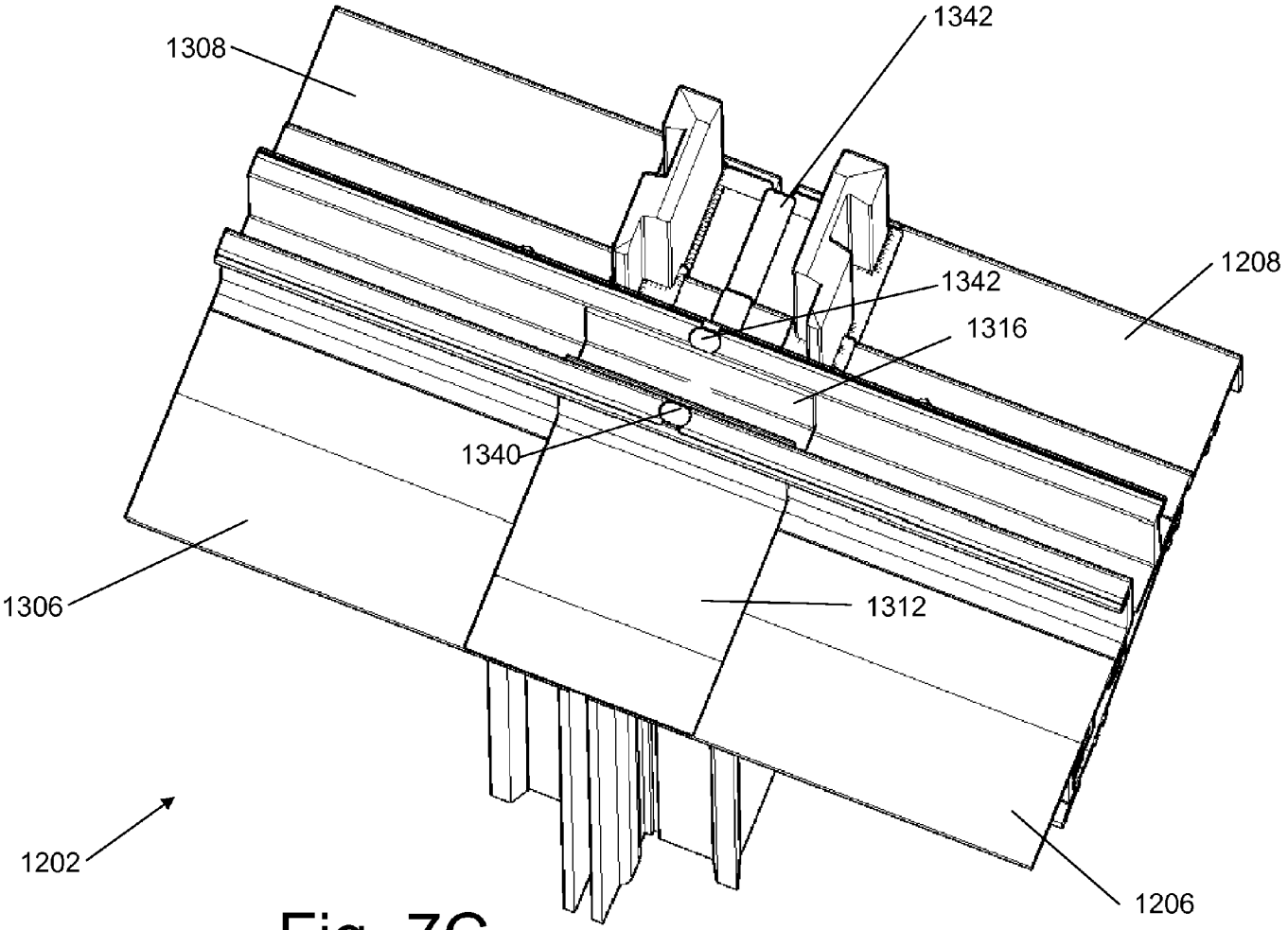
FIG. 7C is a top isometric view illustrating two adjacent lower subsystems coupled together.
Figure 7D:
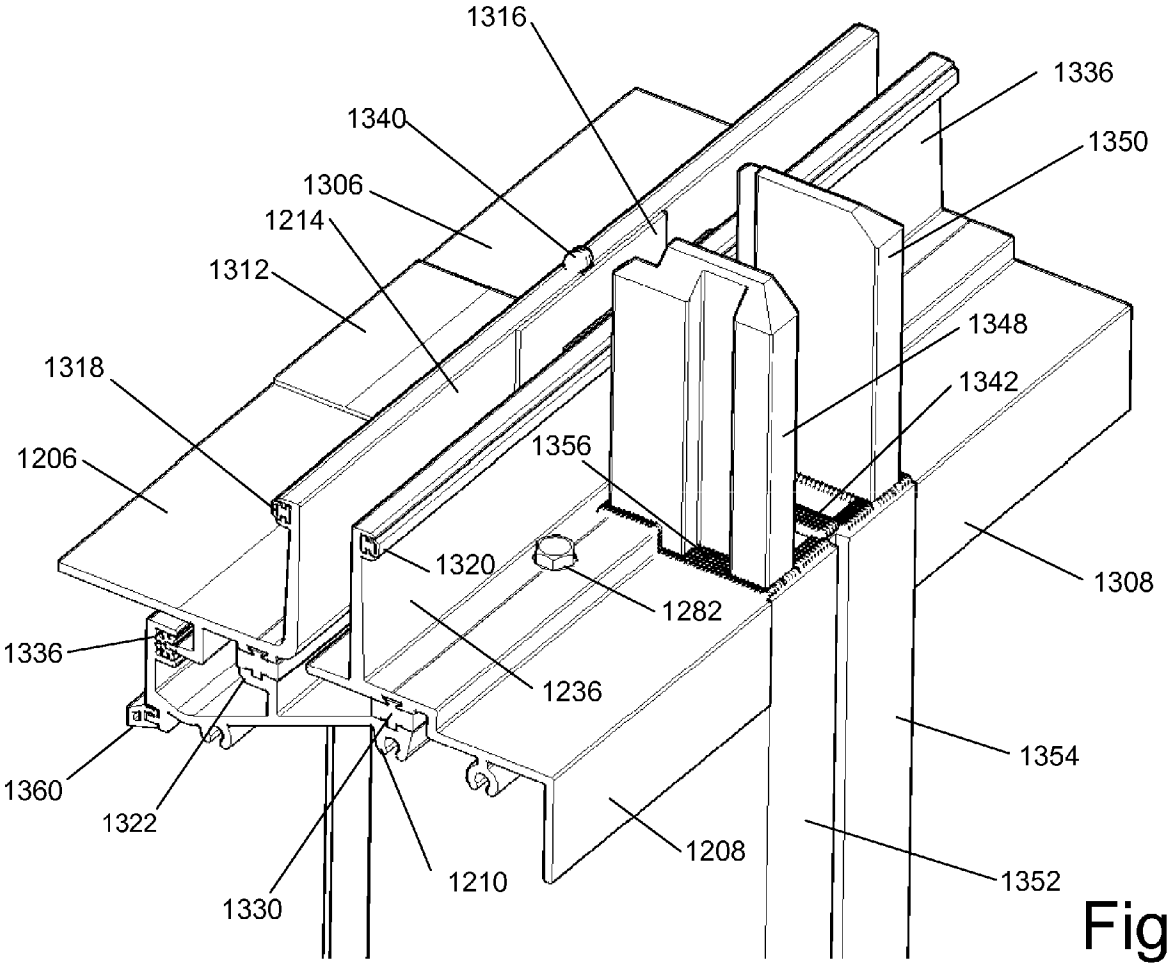
FIG. 7D is a traditional isometric view illustrating two adjacent lower subsystems coupled together.

Now that exemplary features and geometry of the front leg 1206, the back leg 1208, and the joint gutter 1210 have been described, attention will be directed to FIGS. 7B, 7C and 7D. FIG. 7B is a section view of the stack joint lower subsystem 1202 cut at where the subsystem 1202 from one of units meets a similar subsystem from an adjacent unit. FIG. 7C is a top isometric view of a lower subsystem 1202 for the entire stack joint which is formed by two adjacent subsystems 1202. Similarly, FIG. 7D is a side isometric view of the lower subsystem 1202 for the entire stack joint.

Turning now to FIGS. 7B, 7C, and 7D, as discussed above, the lower subsystem 1202 comprises the male front leg 1206, the male back leg 1208, and the joint gutter 1210. As illustrated in FIGS. 7C and 7D, when the units are assembled, the male front leg 1206 is positioned adjacent to a female front leg 1306 of an adjacent subsystem of an adjacent unit. Similarly, the male back leg 1208 couples with a female back leg 1308 of an adjacent subsystem of the adjacent unit.

As illustrated in FIGS. 7B, 7C and 7D in certain embodiments, the top surfaces of the male front leg 1206 and the female front leg 1306 may be coupled to a silicone boot 1312 at the joint. Once the male front leg 1206 and male back leg 1208 are assembled, the vertical leg 1214 and the vertical leg 1236 form a channel 1314. At the joint, the interior of the channel 1314 may be lined with a second silicone boot 1316. The silicone boot 1312 prevents water from running down the joint created by the male front leg 1206 and the female front leg 1306. Similarly, the silicone boot 1316 prevents water from running down the joint created by the male back leg 1208 and the female back leg 1308.

A weather seal, such as a gasket 1318 may be inserted into the groove 1234 defined within the vertical leg 1214. Similarly, a second weather seal, such as a gasket 1320 may be inserted into the groove 1250 defined within the vertical leg 1236 of the male back leg 1208. In certain embodiments, a thermal isolator, such as a rigid PVC spacer strip 1322 may be inserted horizontally into space defined by the lower surface 1218 of the horizontal leg 1212 of the male front leg 1206 and the top face of the connecting portion 1277 of the extension member 1276 of the joint gutter 1210. In certain embodiments, the PVC spacer strip 1322 may have openings (not shown in FIG. 7B) sized to allow one or more assembly screws (not shown) to pass through the openings. In certain embodiments, the PVC spacer strip 1322 is positioned such that the openings of the PVC spacer strip align with the screw holes 1226 and 1252. Thus, the assembly screw 1228 may extend into the screw hole 1226 of the horizontal leg 1212 through the PVC spacer strip 1322 and through the screw hole 1252 of the connecting portion 1277 of the front leg 1206. In other words, the front leg 1206 and the joint gutter 1210 may be connected, but remain relatively thermally isolated.

In certain embodiments, another thermal isolator, such as a rigid PVC spacer strip 1330 may be inserted horizontally into the space defined by the bottom face of the intermediate section 1240 of the male back leg 1208 and the top face of the connecting portion 1278 of the joint gutter 1210. In certain embodiments, the PVC spacer strip 1330 has one or more openings sized to allow one or more assembly screws 1282 to pass through the opening. In certain embodiments, the PVC spacer strip 1330 is positioned such that the PVC spacer strip openings align with the screw holes 1254 and 1280. Thus, the assembly screw 1282 may extend into the screw hole 1254 of the intermediate section 1240 through the PVC spacer 1330 and through the screw hole 1280 of the connecting portion 1278 of the joint gutter 1210. In other words, the back leg 1208 and the joint gutter 1210 may be connected, but remain relatively thermally isolated.

A third thermal isolator, such as a rigid PVC tubular member 1336 may be inserted into the groove 1266 (FIG. 7A) defined within the vertical leg 1260 of the joint gutter 1210 to form a third thermal isolating connection. A circular end portion 1338 of the curved protrusion 1216 may be inserted into the tubular member 1336 as illustrated in FIG. 7D. Thus, the front leg 1206 and the joint gutter 1210 may be connected, but remain relatively thermally isolated.

Thus, the lower joint subsystem 1202 includes the male front leg 1206 (having a first vertical leg 1214) which is coupled to the male back leg 1208 (having a second upper or vertical leg 1236) via a thermal isolation joint (e.g., the assembly screw 1228 and the PVC spacer 1322). The subsystem 1202 also includes the joint gutter 1210 which couples to the front leg 1206 via a second thermal isolation joint (e.g., the curved protrusion 1216 and the PVC tubular member 1336 which allows some rotation) and couples to the back leg 1208 via a third isolation joint (e.g., the assembly screw 1282 and the PVC spacer 1330).

As illustrated in FIGS. 7C and 7D, the male front leg 1206 is positioned longitudinally adjacent to the female front leg 1306. A field applied silicone seal 1340 may be applied between the male front leg 1206 and the female front leg 1306. Similarly, the male back leg 1208 is positioned longitudinally adjacent to the female back leg 1308. A field applied silicone seal 1342 may be applied between the male back leg 1206 and the female back leg 1306.

In certain embodiments, there may be one or more weep holes defined with a lower surface of the joint gutter, a baffle 1344 may be positioned at the weep hole in order to minimize air from infiltrating the joint (See FIG. 7B).

In certain embodiments, there may also be vertical mullion splice members 1348 and 1350 which may also function as lifting lugs. The vertical mullion splice member 1348 may be coupled to a vertical split mullion male member 1352 (see FIG. 7D). Similarly, the vertical mullion splice member 1350 may be coupled to a vertical split mullion female member 1354 (see FIG. 7D). In certain embodiments, a shop applied silicone seal 1356 may be applied between the male back leg 1208 and the vertical splice member 1348. Similarly, a shop applied silicone seal (not shown) may be applied between the female back leg 1308 and the vertical mullion splice member 1350 to prevent water from seeping through the joint. In various locations, other gaskets and seals may be used to prevent water infiltration such as glazing seal 1358 or gasket 1360 as is known in the art (FIG. 7B). Field applied seals or caulking may also be used such as 1390*a*, 1390*b*, and 1390*c*.

Turning back to FIG. 7D, three thermal isolation members (e.g., PVC spacer 1322, PVC spacer 1330, and PVC tubular member 1336) isolate the interior male back leg 1208 from the exterior elements: front leg 1206 and joint gutter 1210. Additionally, the vertical leg 1214 of the front leg 1206 and the vertical leg 1236 of the back leg 1208 along with the gaskets 1318 and 1320 proved a dual line of defense for the stack joint. The subsystem 1202 also provides for internal weepage through weep holes and baffles, such as baffle 1344 (not shown).

Figure 8A:
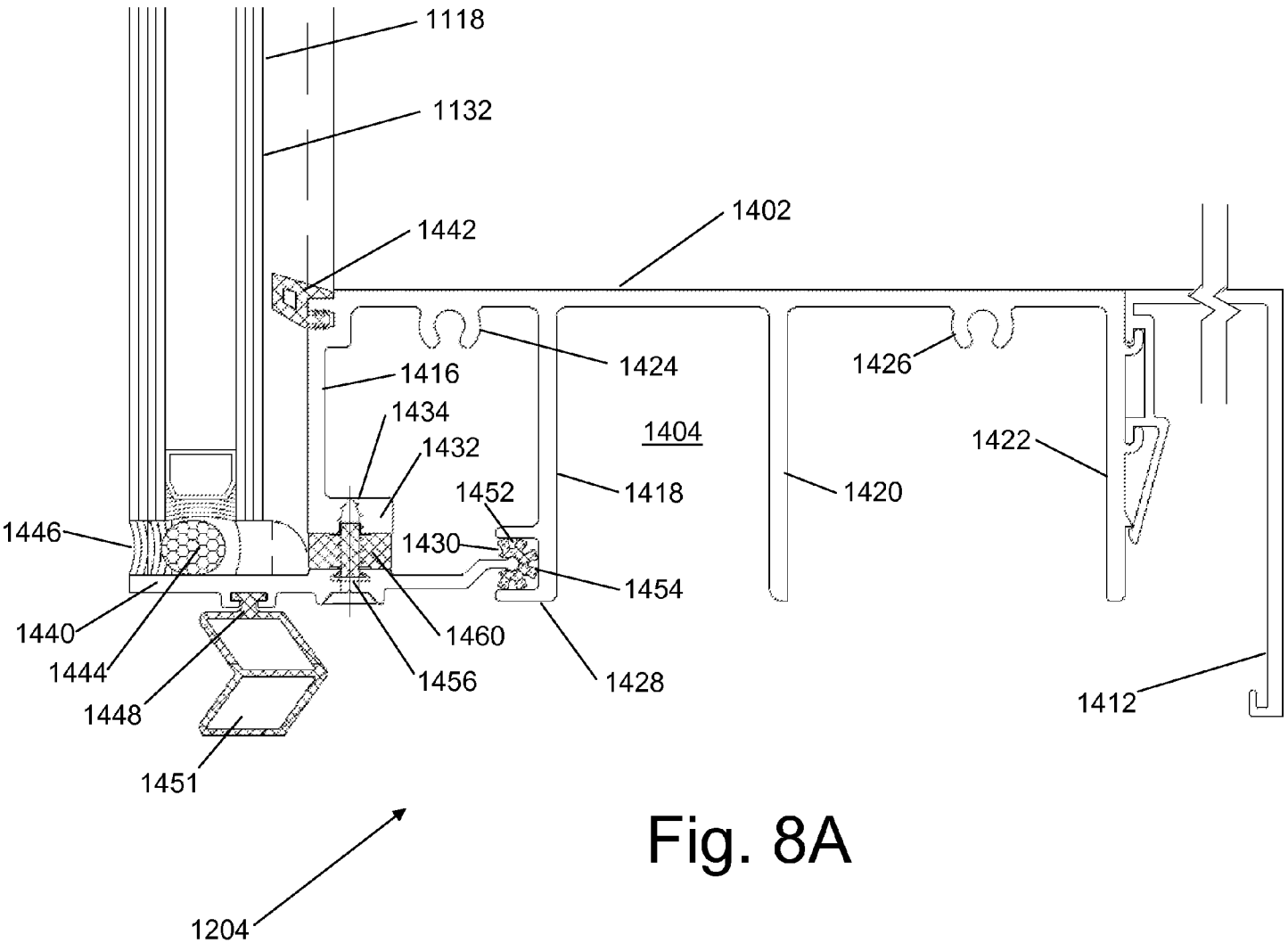
FIG. 8A is a section view illustrating one embodiment of an upper subsystem of the system of FIG. 6.

The Upper Subsystem (Second Embodiment):

FIG. 8A is a section view through certain horizontal members of the upper subsection 1204 of FIG. 6 (or lower framing member of a curtain wall unit). As illustrated, in certain embodiments, a stack joint female member 1402 may have a plurality of downward pointing vertical members or legs, such as vertical leg 1416, vertical leg 1418, vertical leg 1420 and vertical leg 1422. Vertical leg 1418 and vertical 1420 form the channel 1404 and are spaced such that they can accept the vertical legs 1214 and 1236 of the lower subsystem 1202 (See FIG. 6 and FIG. 7B) to create an air tight or pressurized chamber (chamber 2209 of FIG. 6). In certain embodiments, the stack joint female member 1402 may also have screw splines 1424 and 1426 for coupling with out of plane screws (not shown).

In certain embodiments, a groove portion 1428 forming a longitudinal groove 1430 may be defined at the lower end of the vertical leg 1418. The vertical leg 1416 may have a connecting portion 1432. In certain embodiments, one or more screw hole(s) 1434 is defined within the connecting portion 1432.

A horizontal fin 1440 may be used to support a lower panel of glass, such as lower panel 132 of vision glass which may be part of an upper unit, such as top framing member 118 (FIG. 1). In certain embodiments, a gasket 1442 may be coupled to the upper stack joint female member 1402 and positioned such that the gasket 1442 is between the upper stack joint member 1402 and the lower panel 132 of vision glass. A backer rod 1444 and seal 1446 may be positioned between the lower panel 132 and the horizontal fin 1440 as illustrated in FIG. 8A. In certain embodiments, there may be a longitudinal groove 1448 for accepting and coupling with a gasket 1451 that is positioned between the horizontal fin 1440 and the male front leg 1206 of the lower subsystem 1202.

In section, an interior end 1452 of the horizontal fin 1440 is circular and is designed to fit within a thermal isolator, such as a rigid partially tubular PVC member 1454. In turn, the rigid PVC tubular member 1454 may be sized to be inserted into the groove 1430 defined within the vertical leg 1418 of upper stack joint member 1402 to form a thermal isolating connection. Thus, the vertical leg 1418 and the horizontal fin 1440 may be connected, but remain relatively thermally isolated.

In certain embodiments, the horizontal fin 1440 may have one or more screw holes 1456 such that when the horizontal fin is coupled to the stack joint member 1402, the screw hole 1456 and screw hole 1434 align so that an assembly screw 1458 may be placed in the screw holes to couple the connecting portion 1432 of the vertical leg 1416 to the horizontal fin 1440. The assembly screw 1458 may go through a thermal isolating member, such as a PVC spacer strip 1460 which may be positioned between the horizontal fin 1440 and the connecting portion 1432 of the vertical leg 1416.

In certain embodiments, the PVC spacer strip 1460 may be inserted horizontally into grooves defined within the bottom face of the connecting portion 1432 of the vertical leg 1416 and defined within the top face of the horizontal fin 1440. In certain embodiments, the PVC spacer strip 1460 may have openings (not shown in FIG. 8B) sized to allow one or more assembly screw(s) (not shown) to pass through the openings. In certain embodiments, the PVC spacer strip 1460 is positioned such that the openings of the PVC spacer strip align with the screw holes 1434 and 1456. Thus, the stack joint member 1402 may be coupled and supports the horizontal fin 1440, but is thermally isolated from the horizontal fin via the PVC spacer strip 1460 and the rigid tubular PVC tubular member 1454.

Figure 8B:
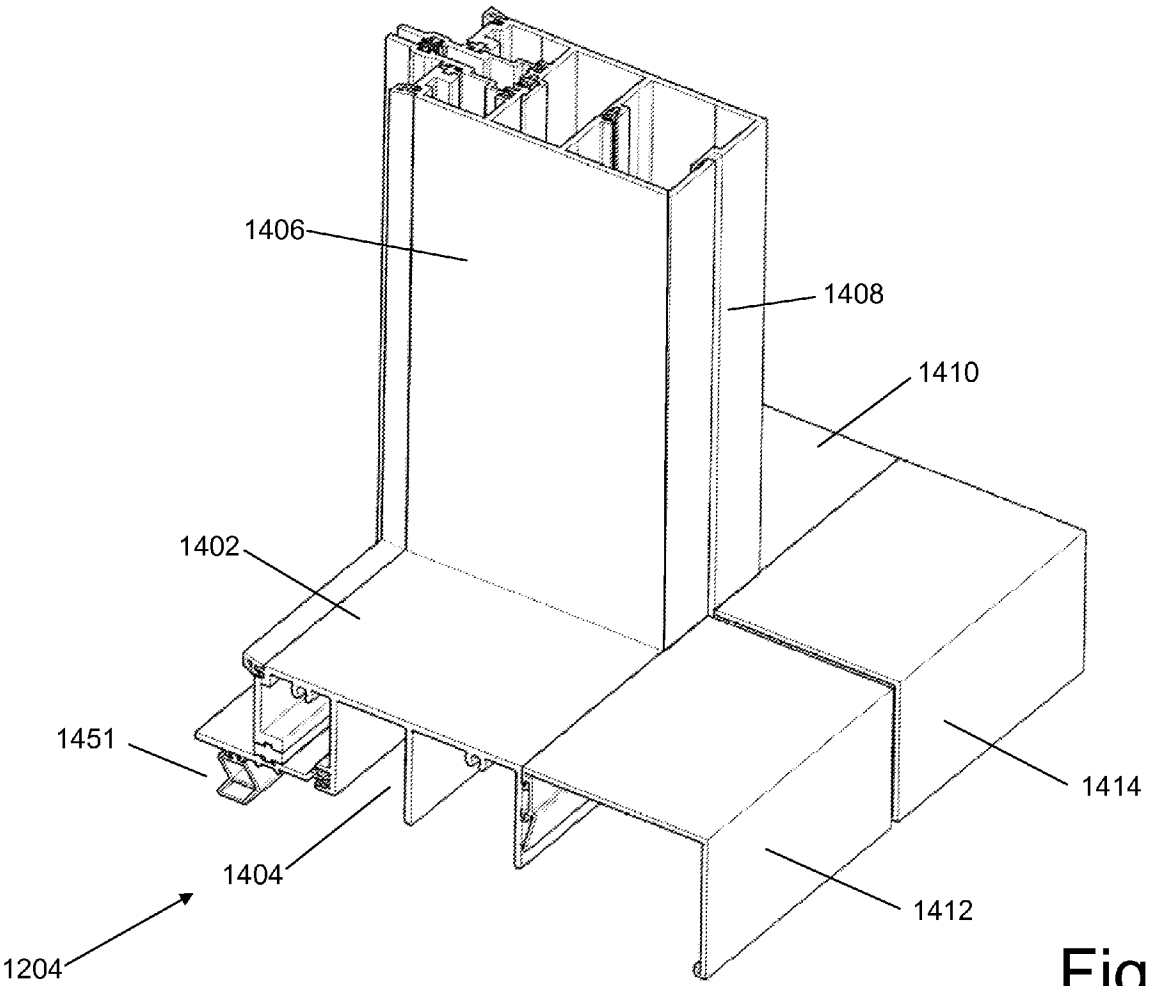
FIG. 8B is a traditional isometric view illustrating one embodiment of two adjacent upper subsystems coupled to a vertical mullion subsystem.

The female or upper stack joint female member 1402 may be made of extruded aluminum. In certain embodiments, the stack joint female member 1402 may be coupled to a split male mullion 1406 as illustrated in FIG. 8B. A split female mullion 1408 may be coupled to a stack joint female member 1410 of an adjacent unit. If required, the stack joint female members 1402 and 1410 may be coupled to snap on sill trim members 1412 and 1414, respectively.

The foregoing description of the embodiments of the invention has been presented for the purposes of illustration and description. It is not intended to be exhaustive or to limit the invention to the precise form disclosed. Many combinations, modifications and variations are possible in light of the above teaching. Undescribed embodiments which have interchanged components are still within the scope of the present invention. It is intended that the scope of the invention be limited not by this detailed description, but rather by the claims appended hereto.

What is claimed is:

1. A horizontal stack joint system, comprising:

a lower subsystem, comprising:

an exterior facing stack joint member comprising an exterior vertical leg and a horizontal leg extending towards an exterior direction;

an interior facing stack joint member comprising an interior vertical leg and a second generally horizontal leg extending towards an interior direction;

a gutter member rotatably coupled to the exterior facing stack joint member and fixedly coupled to the interior facing stack joint member such that the exterior vertical leg and the interior vertical leg extend vertically in the same direction and are positioned horizontally apart to create a dual leg projection;

a first thermal isolator positioned between a portion of the exterior facing stack joint member and a first portion of the gutter member;

a second thermal isolator positioned between a portion of the interior facing stack joint member and a second portion of the gutter member;

a first seal coupled to an exterior face of the exterior vertical leg of the exterior facing stack joint member;

a second seal coupled to an interior face of the interior vertical leg of the interior facing stack joint member;

an upper subsystem, comprising:

a generally horizontal joint member having an exterior vertical member projecting from a lower surface, a first interior vertical member projecting from the lower surface, and a second interior vertical member projecting from the lower surface;

a generally horizontal support fixedly coupled to the exterior vertical member and rotatably coupled to the first interior vertical member;

wherein the first interior vertical member and the second vertical member and a portion of the horizontal joint member form a receiving channel sized to receive the dual leg projection.

2. The horizontal stack joint system of claim 1, wherein the lower subsystem further comprises:

a fourth thermal isolator positioned between a second portion of the exterior facing stack joint member and a third portion of the gutter member.

3. The horizontal stack joint system of claim 2, wherein the third portion of the gutter member has a vertical projecting portion ending with a horizontal connecting portion and the vertical projecting portion contains a weep hole system to allow moisture flow.

4. The horizontal stack joint system of claim 1, wherein the upper subsystem further comprises:

a fourth thermal isolator positioned between a portion of the exterior vertical member and a first portion of the generally horizontal support; and a fifth thermal isolator positioned between a portion of the first interior vertical member and a second portion of the generally horizontal support.

5. The horizontal stack joint system of claim 1, wherein the lower subsystem further comprises:

a first leg projecting from an interior surface of the exterior vertical leg;

a second leg projecting from the interior stack joint member;

a fastener coupling the first leg to the second leg; and a fourth thermal isolator positioned between a portion of the exterior facing stack joint member and the interior facing stack joint member.

6. The horizontal stack joint system of claim 1, wherein the gutter member further comprises a vertical member and an inclined member.

7. The horizontal stack joint system of claim 1, wherein the vertical member of gutter member further comprises a groove sized to house a semi-circular thermal isolator.

8. The horizontal stack joint system of claim 1, wherein the exterior facing stack joint member further comprises a projecting member having a tubular end for coupling to a semi-circular thermal isolator.

9. The portion of a curtain wall system of claim 1, wherein the exterior facing stack joint member further comprises a projecting member having a circular end for coupling to a semi-circular thermal isolator.

10. A portion of a curtain wall system, the portion comprising:

a first horizontal stack joint system, the first horizontal stack joint system comprising:

a first exterior facing stack joint member comprising a first exterior vertical leg and a first horizontal leg extending towards an exterior direction;

a first interior facing stack joint member comprising a first interior vertical leg and a second generally horizontal leg extending towards an interior direction;

a first gutter member rotatably coupled to the first exterior facing stack joint member and fixedly coupled to the first interior facing stack joint member such that the first exterior vertical leg and the first interior vertical leg extend vertically in the same direction and are positioned horizontally apart to create a first dual leg projection;

a first thermal isolator for the first stack joint system positioned between a portion of the first exterior facing stack joint member and a first portion of the first gutter member;

a second thermal isolator for the first stack joint system positioned between a portion of the first interior facing stack joint member and a second portion of the first gutter member;

a first seal for the first stack joint system coupled to an exterior face of the first exterior vertical leg of the first exterior facing stack joint member;

a second seal for the first stack joint system coupled to an interior face of the first interior vertical leg of the first interior facing stack joint member;

a second horizontal stack joint system positioned horizontally adjacent to the first horizontal stack joint system, the second horizontal stack joint system comprising:

a second exterior facing stack joint member comprising a second exterior vertical leg and a second horizontal leg extending towards the exterior;

a second interior facing stack joint member comprising a second interior vertical leg and a second generally horizontal leg extending towards the interior;

a second gutter member rotatably coupled to the second exterior facing stack joint member and the fixedly coupled to second interior facing stack joint member such that the second exterior vertical leg and second interior vertical leg extend vertically in the same direction and are positioned horizontally apart to create a second dual leg projection;

a first thermal isolator for the second stack joint system positioned between a portion of the second exterior facing stack joint member and a first portion of the second gutter member;

a second thermal isolator for the second stack joint system positioned between a portion of the second interior facing stack joint member and a second portion of the second gutter member;

a first seal for the second stack joint system coupled to an exterior face of the second exterior vertical leg of the second exterior facing stack joint member;

a second seal for the second stack joint system coupled to an interior face of the second interior vertical leg of the second interior facing stack joint member;

wherein a seal is positioned over a portion of the first exterior facing stack joint member and over a portion of the second exterior facing stack joint member, and wherein a first mullion splicing member is coupled to the first interior facing stack joint member and a second mullion splicing member is coupled to the second interior facing stack member.

11. The portion of a curtain wall system of claim 10, wherein each horizontal stack systems further comprises:

a fourth thermal isolator positioned between a second portion of the exterior facing stack joint member and a third portion of the gutter member.

12. The portion of a curtain wall system of claim 11, wherein the third portion of the gutter member has a vertical projecting portion ending with a horizontal connecting portion and the vertical projecting portion contains a weep hole system to allow moisture flow.

13. The portion of a curtain wall system of claim 10, wherein the lower subsystem further comprises:

a first leg projecting from an interior surface of the exterior vertical leg;

a second leg projecting from the interior stack joint member;

a fastener coupling the first leg to the second leg; and a fourth thermal isolator positioned between a portion of the exterior facing stack joint member and the interior facing stack joint member.

14. The portion of a curtain wall system of claim 10, wherein the gutter member further comprises a vertical member and an inclined member.

15. The portion of a curtain wall system of claim 10, wherein the vertical member of gutter member further comprises a groove sized to house a semi-circular thermal isolator.

16. A curtain wall unit comprising:

a first horizontal stack joint member system comprising:

an exterior facing stack joint member comprising an exterior vertical leg and a horizontal leg extending towards an exterior direction;

an interior facing stack joint member comprising an interior vertical leg and a second generally horizontal leg extending towards an interior direction;

a gutter member rotatably coupled to the exterior facing stack joint member and fixedly coupled to the interior facing stack joint member such that the exterior vertical leg and the interior vertical leg extend vertically in the same direction and are positioned horizontally apart to create a dual leg projection;

a first thermal isolator positioned between a portion of the exterior facing stack joint member and a first portion of the gutter member;

a second thermal isolator positioned between a portion of the interior facing stack joint member and a second portion of the gutter member;

a first seal coupled to an exterior face of the exterior vertical leg of the exterior facing stack joint member;

a second seal coupled to an exterior face of the interior vertical leg of the interior facing stack joint member;

a second horizontal stack joint member system comprising:

a generally horizontal joint member having an exterior vertical member projecting from a lower surface, a first interior vertical member projecting from the lower surface, and a second interior vertical member projecting from the lower surface;

a generally horizontal support fixedly coupled to the exterior vertical member and rotatably coupled to the first interior vertical member;

wherein the first interior vertical member and the second vertical member and a portion of the horizontal joint member form a receiving channel sized to receive the dual leg projection;

a first mullion member coupling the first horizontal stack member system to the second horizontal stack member system; and a second mullion member coupling the first horizontal stack member system to the second horizontal stack member system.

17. The curtain wall unit of claim 16, wherein the first horizontal stack member system is positioned above the second horizontal stack member system.

18. The curtain wall unit of claim 16, wherein the second subsystem further comprises:

a fourth thermal isolator positioned between a second portion of the exterior facing stack joint member and a third portion of the gutter member.

19. The curtain wall unit of claim 16, wherein the first subsystem further comprises:

a fourth thermal isolator positioned between a portion of the exterior vertical member and a first portion of the generally horizontal support; and a fifth thermal isolator positioned between a portion of the first interior vertical member and a second portion of the generally horizontal support.

20. The horizontal stack joint system of claim 16, wherein the gutter member further comprises a vertical member and an inclined member.

* * * * *